US011299940B2

(12) United States Patent
Slack

(10) Patent No.: US 11,299,940 B2
(45) Date of Patent: Apr. 12, 2022

(54) AXIAL-STROKE-ACTUATED ROTARY LATCH RELEASE MECHANISM

(71) Applicant: NOETIC TECHNOLOGIES INC., Edmonton (CA)

(72) Inventor: Maurice William Slack, Edmonton (CA)

(73) Assignee: Noetic Technologies Inc.

( * ) Notice: Subject to any disclaimer, the term of this patent is extended or adjusted under 35 U.S.C. 154(b) by 344 days.

(21) Appl. No.: 16/624,684

(22) PCT Filed: Jul. 20, 2018

(86) PCT No.: PCT/CA2018/000144
§ 371 (c)(1),
(2) Date: Dec. 19, 2019

(87) PCT Pub. No.: WO2019/014747
PCT Pub. Date: Jan. 24, 2019

(65) Prior Publication Data

US 2020/0131864 A1 Apr. 30, 2020

Related U.S. Application Data

(60) Provisional application No. 62/535,062, filed on Jul. 20, 2017.

(51) Int. Cl.
*E21B 19/06* (2006.01)
*E21B 19/16* (2006.01)

(52) U.S. Cl.
CPC ..... *E21B 19/06* (2013.01); *E21B 19/16* (2013.01)

(58) Field of Classification Search
CPC ..... E21B 19/06; E21B 19/16; E21B 19/161
See application file for complete search history.

(56) References Cited

U.S. PATENT DOCUMENTS 2,028,966 A * 1/1936 Burns ..... E21B 31/18 294/86.21
7,909,120 B2 3/2011 Slack
(Continued)

FOREIGN PATENT DOCUMENTS

CN 106812480 A 6/2017

OTHER PUBLICATIONS

International Search Report re PCT/2018/000144, issued by the ISA/CA dated Sep. 28, 2019.
(Continued)

*Primary Examiner* — Christopher J Sebesta
(74) *Attorney, Agent, or Firm* — Donald V. Tomkins

(57) ABSTRACT

A rotary latch release mechanism includes axially-aligned upper and lower rotary latch components carried on and rotationally coupled to upper and lower latch assemblies, respectively. The latch release mechanism is movable from an axially-latched position to an axially-unlatched position in response to relative rotation between the upper and lower rotary latch components. The latch release mechanism has a movable land surface that acts in response to relative axial displacement to induce the relative rotation required to release the latch. The latch release mechanism may be configured such that the axial movement of the movable land surface will cause the relative axial movement required to release the latch in combination with the required rotation. Accordingly, the rotary latch mechanism operates in response to externally-controlled axial movement of a movable land surface carried by the latch release mechanism, without requiring externally-induced rotation.

13 Claims, 12 Drawing Sheets

(56) References Cited

U.S. PATENT DOCUMENTS

| | | | | |
|---|---|---|---|---|
| 9,869,143 | B2 | 1/2018 | Slack | |
| 2011/0100621 | A1 | 5/2011 | Slack | |
| 2012/0013133 | A1* | 1/2012 | Rios, III | E21B 33/038 292/159 |
| 2012/0273232 | A1* | 11/2012 | O'Blenes | E21B 19/16 166/380 |
| 2013/0146298 | A1* | 6/2013 | Ellison | E21B 33/038 166/338 |
| 2016/0090802 | A1* | 3/2016 | Nguyen | E21B 33/04 166/217 |
| 2017/0183923 | A1 | 6/2017 | Bansal et al. | |

OTHER PUBLICATIONS

Written Opinion of the International Searching Authority re PCT/2018/000144, issued by the ISA/CA dated Sep. 28, 2019.

* cited by examiner

AXIAL-STROKE-ACTUATED ROTARY LATCH RELEASE MECHANISM

FIELD

The present disclosure relates in general to devices and mechanisms for releasably latching two coaxially-positioned and mating rotary components such that relative axial displacement of the rotary components is prevented when in the latched position, but axial displacement is allowed when the rotary components are in the unlatched position.

BACKGROUND

Power tongs have for many years been used to "make up" (i.e., assemble) threaded connections between sections (or "joints") of tubing, and to "break out" (i.e., disassemble) threaded connections when running tubing strings into or out of petroleum wells, in coordination with the hoisting system of a drilling rig. Tubing strings typically comprise a number of tubing sections having externally-threaded ends, joined end to end by means of internally-threaded cylindrical couplers mounted at one end of each tubing section, forming what is commonly called the "box" end, while the other externally-threaded end of the tubing section is call the "pin" end. Such tubular strings can be relatively efficiently assembled or disassembled using power tongs to screw additional tubing sections into a tubing string during make-up operations, or to unscrew tubing sections from a tubing string being pulled from a wellbore (i.e., break-out operations).

However, power tongs do not simultaneously support other beneficial functions such as rotating, pushing, or fluid filling, after a pipe segment is added to or removed from the string, and while the string is being lowered or raised in the wellbore. Running tubulars with tongs, whether powered or manual, also typically requires the deployment of personnel in comparatively high hazard locations such as on the rig floor and on so-called "stabbing boards" above the rig floor.

The advent of drilling rigs equipped with top drives has enabled another method of running tubing strings, and casing strings in particular, using tools commonly known as casing running tools or CRTs. These tools are adapted to be carried by the top drive quill, and to grip the upper end of a tubing section and to seal between the bore of the tubing section and the bore of the top drive quill. In coordination with the top drive, CRTs support hoisting, rotating, pushing, and filling of a casing string with drilling fluid while running casing into a wellbore.

Ideally, these tools also support the make-up and break-out operations, traditionally performed using power tongs, thereby eliminating the need for power tongs entirely, with attendant benefits in terms of reduced system complexity and increased safety. As a practical matter, however, obtaining these benefits without negatively impacting running rate or consistency requires the time taken to make up connections using CRTs to be at least comparable to the running rate and consistency achievable using power tongs. In addition, it is a practical necessity that making up tubing strings using CRTs does increase the risk of damage to the connection threads, or to seals in so-called "premium connections" where these are present.

U.S. Pat. No. 7,909,120 (Slack) [the contents of which are incorporated herein in their entirety, in jurisdictions where so permitted] teaches a prior art CRT in the form of a gripping tool that includes a body assembly comprising:

- a load adaptor coupled for axial load transfer to the remainder of the body assembly, and adapted for structural connection to a selected one of a drive head or a reaction frame;
- a gripping assembly carried by the body assembly and having a grip surface, wherein the gripping assembly is provided with activating means to radially stroke or move the grip surface from a retracted position to an engaged position in which the grip surface tractionally engages either an interior surface or an exterior surface of a tubular workpiece in response to relative axial movement or axial stroke of the body assembly in at least one direction relative to the grip surface; and
- a linkage acting between the body assembly and the gripping assembly, wherein relative rotation of the load adaptor in at least one direction relative to the grip surface will result in axial displacement of the body assembly relative to the gripping assembly, so as to move the gripping assembly from the retracted position to the engaged position in accordance with the action of the actuation means.

For purposes of this patent document, a CRT configured for gripping an internal surface of a tubular workpiece will be referred to as a CRTi, and a CRT configured for gripping an external surface of a tubular workpiece will be referred to as a CRTe.

CRTs as taught by U.S. Pat. No. 7,909,120 utilize a mechanically-actuated gripping assembly that generates its gripping force in response to axial load with corresponding axial stroke, either together with or independently from externally-applied axial load and externally-applied torque load applied by either right-hand or left-hand rotation. These loads, when applied, are carried across the tool from the load adaptor of the body assembly to the grip surface of the gripping assembly, in tractional engagement with the workpiece.

Additionally, such CRTs or gripping tools may be provided with a latch mechanism acting between the body assembly and the gripping assembly, in the form of a rotary J-slot latch having a hook-and-receiver arrangement acting between first and second latch components, where the first latch component is carried by the body assembly and the second latch component is carried by the grip assembly (for example, see FIGS. 1 and 14 in U.S. Pat. No. 7,909,120, showing the latch in externally-gripping and internally-gripping full-tool assemblies respectively, and also FIGS. 4-7 in U.S. Pat. No. 7,909,120, describing how mating latch teeth 108 and 110 act as a hook and receiver with respect to each other.)

When in a first (or latched) position, with the hook in the receiver, this latch prevents relative axial movement between the body assembly and the gripping assembly so as to retain the grip mechanism in a first (or retracted) position. However, relative rotation between the body assembly and the gripping assembly (which rotation is typically resisted by some amount of torque, which will be referred to herein as the "latch actuation torque") will move the mating hook and receiver components to a second (or unlatched) position, thereby allowing relative axial movement between the body assembly and the gripping assembly, with associated movement of the grip surface into the second (or engaged) position. Accordingly, when in the latched position, this latch mechanism will support operational steps that require the gripping assembly to be held in its retracted position, to enable positioning of the tool relative to the workpiece preparatory to engaging the grip surface, and conversely retaining the grip surface in its retracted position enabling separation of the CRT from the workpiece.

Operationally, achieving this relative movement where the CRT is attached to the top drive quill requires the development of sufficient reaction torque, through tractional engagement when the "land surface" of the CRT is brought into contact with the upper end of a tubular workpiece and axial "set-down" force is applied, to resist the latch actuation torque arising from the rotation applied to move the latch into the unlatched position (typically arranged as right-hand rotation) and to cause axial movement if required (i.e., to move the hook up the "slot" of a J-slot). Any operational step moving the latch from the latched position to the unlatched position is said to "trigger" the tool, thus allowing the tool to be "set".

To re-latch, this same requirement for sufficient tractional resistance between the tool's land surface and the workpiece must be met, with the applied torque direction reversed (i.e., typically left-hand rotation) to "un-set" the tool. For mechanically-set CRT tools such as in U.S. Pat. No. 7,909,120, the tractional resistance required to re-latch is less than that required to unlatch.

U.S. Pat. No. 9,869,143 (Slack) [the contents of which are incorporated herein in their entirety, in jurisdictions where so permitted] discusses how it may be difficult in some applications to achieve sufficient tractional resistance between the land surface of a CRT and a workpiece, such as in cases where both the CRT land surface and the contact face of the workpiece are smooth steel, particularly when rotating to release the latch in such tools. U.S. Pat. No. 9,869,143 teaches means for increasing the effective friction coefficient acting between the workpiece and tool under application of compressive load (i.e., the ratio of tractional resistance to applied load). While these teachings disclose effective means for managing this operational variable and thus reducing operational uncertainty, operation of the tool still requires the steps of first setting down a somewhat controlled amount of axial load and then applying rotation with the top drive to move the latch into its unlatched position. Therefore, when the CRT is used to for make-up operations, the time, load, and rotation control to carry out these steps on certain rigs may result in slower cycle times than achievable using power tongs for make-up.

Tubing sections in a tubing string are typically oriented "pin down, box up". Accordingly, during make-up operations, the upper end of the uppermost section in the string, as supported by rig floor slips or a "spider", presents as "box up" in the so-called "stump" into which the pin end of the next tubing section (i.e., workpiece) is stabbed. When using a CRT for make-up, it may be difficult to control the amount of top drive "set-down" load on the stabbed pin and similarly the amount of rotation applied with set-down load present, introducing the possibility of the undesirable situation where the pin end of the workpiece is rotated in the box in the stump before the pin-end and box-end threads are properly engaged, with the attendant risk of galling damage to the threads. While these risks can be ameliorated by careful control of the top drive by the driller, they contribute to both additional uncertainty and increased cycle time.

Accordingly, there is a need for methods and means for reducing the risk of thread damage when using CRTs for make-up, and for providing greater assurance of cycle times comparable to or less than cycle times achievable using power tongs for make-up and other aspects of casing running operations.

SUMMARY OF THE DISCLOSURE

In general terms, the present disclosure teaches non-limiting embodiments of a rotary latch mechanism (alternatively referred to as a trigger mechanism) comprising upper and lower latch assemblies, plus a latch release mechanism comprising an upper rotary latch component carried on and rotationally coupled to the upper latch assembly, and a lower rotary latch component carried on and rotationally coupled to the lower latch assembly. The upper and lower rotary components are adapted to move from a first (or axially-latched) position to a second (or axially-unlatched) position in response to rotation of the lower rotary component relative to the upper rotary component in a first (or unlatching) direction. Such rotation induces the development of an associated latch actuation torque.

The latch release mechanism has a movable land element (alternatively referred to as a "cushion bumper") which carries a downward-facing land surface that acts in response to relative axial displacement to urge relative rotation between the upper and lower rotary latch components, so as to exert the latch actuation torque required to move the latch components from the latched position to the unlatched position. Where needed for latch configurations requiring both relative axial compression movement and rotation (such as commonly required for a J-slot latch), the mechanism may be configured such that the axial movement of the movable land element will cause the relative axial movement required to release the latch in combination with the required rotation. Accordingly, exemplary embodiments in accordance with the present teachings are directed to means for inducing the rotation and latch actuation torque required to move the component forming a rotary latch from the latched position to the unlatched position using externally-controlled axial movement of a movable land element carried by the latch release mechanism, without requiring externally-induced rotation sufficient to move the mechanism from the latched position to the unlatched position.

Latch release mechanisms as disclosed herein eliminate the need for externally-applied rotation after applying set-down force when using a tool such as a mechanical CRT tool that employs a J-latch type mechanism to move from a first (latched) to a second (unlatched) position, by transforming relative axial movement between the tubular workpiece and a component of the tool so as to produce the relative rotation needed to release the latch. This enables a mechanical CRT equipped with such a latch release mechanism (or trigger mechanism) to produce comparable or shorter cycle times with reduced risk of connection thread damage while running casing, as compared to using power tongs for such operations.

In one aspect, the present disclosure teaches embodiments of a rotary latch release mechanism comprising:

- an upper latch assembly and a lower latch assembly, said upper and lower latch assemblies being in axial alignment;
- an upper rotary latch component carried on and rotationally coupled to the upper latch assembly, and a lower rotary latch component carried on and rotationally coupled to the lower latch assembly;
- a bumper element defining a downward-facing land surface, said bumper element being coupled to the lower latch assembly so as to be both axially movable and rotationally movable relative to the lower latch assembly; and
- a trigger element coupled to the bumper element and the lower latch assembly so as to be movable at least axially relative to the bumper element and so as to be axially and rotationally movable relative to the lower latch assembly;

wherein:

the upper and lower rotary latch components are adapted to move from an axially-latched position to an axially-unlatched position in response to relative rotation between the upper and lower rotary latch components in a first rotational direction;

the upper latch assembly defines one or more downward-facing trigger reaction dog pockets; and the trigger element defines one or more upward-facing trigger dog teeth configured for engagement with the one or more trigger reaction dog pockets of the upper latch assembly;

such that when the one or more trigger dog teeth are disposed within the one or more trigger reaction dog pockets, an upward force applied to the land surface of the bumper element will tend to cause relative axially-upward displacement of the bumper so as to urge rotation of the lower latch assembly, wherein the trigger acts acts between the bumper element and through engagement with the trigger dogs with the upper latch assembly so as to force relative rotation between upper and lower latch components to induce axial disengagement of the upper and lower rotary latch components, whereupon continued application of the upward force and resultant axial and rotary displacement of the bumper element relative to the lower latch assembly will cause withdrawal of the one or more trigger dog teeth from the one or more trigger dog reaction pockets.

The rotary latch release mechanism may include a first axially-oriented biasing means acting between the upper and lower latch assemblies so as to bias the latch release mechanism toward the latched position, and a second axially-oriented biasing means acting between the movable bumper element and the trigger element so as to bias the bumper element axially downward relative to the trigger element.

The upper latch assembly may define a downward-facing upper ramp surface that is matingly engageable with an upward-facing lower ramp surface defined by the lower latch assembly, such that the application of an upward force to the land surface of the bumper element will bring the upper and lower ramp surfaces into sliding engagement so as to constrain the relative axial approach of the upper and lower latch assemblies while allowing relative rotation between the upper and lower latch assemblies.

Several exemplary embodiments of latch release mechanisms in accordance with the present disclosure are described below, in the context of use with a CRT tool utilizing a J-latch to retain the grip surface of the CRT in its retracted position, and providing means for triggering the J-latch by application of set-down load without requiring the application of external rotation and latch actuation torque through the load adaptor.

Embodiment #1—Rotary Cushion Bumper Reacted by Casing Friction (Both CRTi and CRTe)

Embodiment #1 relies on tractional resistance to react latch actuation torque. In this embodiment, the latch release mechanism is carried by the lower latch assembly (comprising the grip assembly of a CRT), and has a movable land element (or cushion bumper) with a generally downward-facing land surface adapted for tractional engagement with the upper end of a tubular workpiece. Upward axial compressive movement of the movable land element relative to the lower rotary latch component, in response to contact with a tubular workpiece, causes the latch release mechanism to rotate the lower rotary latch component relative to the upper rotary latch component in the unlatching direction.

The latch release mechanism is further provided with biasing means (such as but not limited to a spring), for biasing the land surface to resist axial compressive displacement relative to the lower rotary latch component, correspondingly producing tractional resistance to rotary sliding between the land surface and the tubular workpiece. Thus arranged, with the upper and lower rotary latch components initially in the axially-latched position, and with the upper latch assembly (comprising the body assembly of a CRT) supported through the load adaptor to resist rotation relative to the tubular workpiece, axial compressive movement transmitted through the load adaptor to the upper rotary latch component relative to the tubular workpiece tends to urge rotation, as well as axial compressive stroke, if required, of the lower rotary latch component relative to the upper rotary latch component, and where tractional resistance between the land surface and the tubular workpiece is sufficient to exceed the latch actuation torque, the axial compressive movement causes rotation relative to the upper rotary latch component to move the lower rotary latch component to the unlatched position.

Embodiment #2—Frictional Trigger Acting Between a Floating Load Adaptor and Main Body: CRTe with Stroke Embodiment #2, like Embodiment #1, relies on tractional resistance to react latch actuation torque. In this embodiment, the upper latch assembly has a load adapter slidingly coupled to a main body to carry axial load while still allowing axial stroke. The upper rotary latch component is axially carried by the main body, but is rotationally coupled to the load adaptor. The lower latch assembly is carried by and is rotationally coupled to the main body, while allowing axial sliding, over at least some range of motion, when in the unlatched position. The lower latch assembly is further adapted to carry a land surface for contact with a tubular workpiece to support set-down loads and to provide tractional resistance to rotation.

The latch release mechanism is carried by a selected one of the load adaptor and the main body, and has a generally axially-facing movable clutch surface adapted for tractional engagement with an opposing reaction clutch surface on the other of the load adaptor and the main body. Axial compressive movement of the movable clutch surface relative to the reaction clutch surface, as urged by set-down force applied to the load adaptor, causes the latch release mechanism to urge rotation between the load adaptor and the main body in the unlatching direction. The latch release mechanism is further provided with biasing means (such as but not limited to a spring), for biasing the movable clutch surface to resist axial compressive displacement relative to the component on which it is carried (i.e., either the load adaptor or the main body), correspondingly producing tractional resistance to rotary sliding between the contacting movable clutch surface and the reaction clutch surface (or clutch interface).

Thus arranged, with the upper and lower rotary latch components initially in the axially-latched position, and with the load adaptor supported to generally allow free rotation relative to the main body and hence the tubular workpiece, axial compressive movement within the axial stroke allowance of the load adaptor relative to the main body tends to urge rotation, and axial compressive stroke if required, of the upper rotary latch component relative to the lower rotary latch component. Where the tractional resistance of the clutch interface is sufficient to exceed the latch actuation torque (and perhaps some external resistance torque of the generally freely-rotating load adaptor), the axial compressive movement induces rotation of the upper rotary latch component relative to the lower rotary latch component to move to the unlatched position.

Where free rotation of the load adaptor is inhibited, the rotation urged by set-down load tends to urge sliding at the clutch interface and at the land-to-workpiece interface. The corresponding torque induced at these two interfaces, upon application of sufficient set-down load, will thus tend to induce sliding on one interface or the other. If sliding occurs on the land-to-workpiece interface, the rotation necessary to release the latch will occur. However, if sliding occurs at the clutch interface, then relative rotation of the latch components will not occur, rendering the latch release mechanism ineffective for its intended purpose in these particular circumstances. It may therefore be advantageous to provide means for increasing the torsional resistance of the clutch interface to increase the effective tractional resistance under application of axial load, such as by providing these mating surfaces as conically-configured surfaces to increase the normal force driving rotational tractional resistance, for a given axial load. Such modifications may be provided in the absence of or in combination with contouring or other surface treatments for increasing frictional resistance.

However, in all cases where it is desired to allow for re-latching, the tractional resistance to rotation occurring at the clutch interface will tend to impede the relative rotation of upper and lower rotary latch components if set-down load is required to effect re-latching. For certain applications it may be possible to reliably control the tractional response of these two interfaces by providing a selected combination of bias spring force, contact surface geometry, and surface treatment of the clutch and land-to-workpiece surfaces, in coordination with load control sufficient to reliably prevent clutch interface slippage in support of latch release rotation for a first compressive load, while simultaneously allowing clutch interface slippage without resultant land-to-workpiece slippage to support re-latching, for a second selected compressive load in combination with applied rotation.

As described above, Embodiments #1 and #2 rely on the presence of sufficient tractional engagement between contacting components for reliable unlatching with set-down movement. In Embodiment #1, the only limiting tractional resistance is between the tubular workpiece and the cushion bumper, with the additional constraint that the latch actuation torque is further resisted by external support carrying the upper latch assembly. To state this otherwise, relative rotation between the upper rotary latch component and the tubular workpiece must be largely prevented (at least in the unlatching direction) to support grip engagement without externally-applied rotation.

In Embodiment #2, sufficient tractional resistance of the clutch interface is required, typically with the added constraint of free rotation of the load adaptor of the upper latch assembly. For applications where these boundary conditions can be readily and reliably met, Embodiments #1 and #2 can provide the benefits of faster cycle times and reduced risk of connection thread damage, plus the benefit of comparative mechanical simplicity. However, for applications where these boundary conditions cannot be readily achieved, means can be provided for releasing a J-latch independent of available tractional resistance or control of top drive rotation, as in alternative embodiments described below.

Embodiment #3—Latch Release Mechanism Adapted for "Base Configuration": CRTs Incorporating a Latching Tri-Cam Assembly Embodiment #3 is configured to force relative rotation of the upper and lower rotary latch components through the latch release mechanism. In this embodiment:

- the upper rotary latch component is rigidly carried by a main body of the upper latch assembly;
- the lower rotary latch component is rotationally and axially constrained and carried by the lower latch assembly, which acts in coordination with the main body to prevent relative rotary and axial movement when the upper and lower rotary latch components are latched;
- the latch release mechanism acts between the upper and lower latch assemblies and comprises three main elements generally corresponding to components of a latching tri-cam assembly as disclosed in International Publication No. WO 2010/006441 (Slack) and in the corresponding U.S. Patent Publication No. 2011/0100621 [the contents of which are incorporated herein in their entirety, in jurisdictions where so permitted]):
  - a trigger reaction ring having one or more downward-facing reaction dog pockets rigidly attached to the upper latch assembly;
  - a trigger element carried by the lower latch assembly and having one or more upward-facing trigger dog teeth generally mating and interacting with the downward-facing reaction dog pockets; and
  - a movable land element also carried by the lower latch assembly, and provided with a generally downward-facing land surface adapted for axial compressive engagement with the upper end of a tubular workpiece.

The movable land element and the trigger element are coupled to each other and to the lower latch assembly such that upon upward axial compressive movement or stroke of the movable land element relative to the lower latch assembly from a first (or land) position to a second (or fully-stroked) position, as urged by contact with a tubular workpiece, will urge rotation and downward axial movement of the trigger dog teeth. Initially, the rotation of the trigger dog teeth is prevented by interaction with the reaction dog pockets which causes rotation of the lower rotary latch component relative to the upper rotary latch component to their unlatched position, and when the movable land element is fully stroked, the trigger dog teeth are fully retracted and disengaged from the reaction dog pockets. The retraction of the trigger dog teeth from the reaction dog pockets supports re-latching under application of external rotation in the re-latching direction. This embodiment preferably includes biasing means tending to resist both the axial compression of the movable land element and the retraction of the trigger element, so that the land and trigger elements return to their initial positions upon unloading and withdrawal from the tubular workpiece.

Embodiment #4—Retracting Trigger Acting Between a Floating Load Adaptor and Main Body: CRTe with Stroke Embodiment #4, like Embodiment #3, is configured to force relative rotation of the upper and lower rotary latch components through the latch release mechanism. In this embodiment:

the upper latch assembly includes a load adapter, coupled to a main body so as to carry axial load while allowing axial stroke;

the upper rotary latch component is axially carried by the main body but is rotationally coupled to the load adaptor;

the lower latch assembly (comprising the grip assembly of a CRT) is carried by and rotationally coupled to the main body while permitting axial movement, over at least some range of motion, when the latch is in its unlatched position; and the lower latch assembly is further adapted to carry a land surface for contact with a tubular workpiece to support set-down loads and to provide tractional resistance to rotation.

The latch release mechanism is provided to act between the sliding load adaptor and main body, and, similar to Embodiment #3, comprises three main elements:

reaction dog pockets carried by a selected one of the load adaptor and the main body;

a trigger element having trigger dog teeth; and a intermediate trigger element carried by the other of the load adaptor and the main body.

In the following discussion, it will be assumed that the reaction dog pockets are upward-facing and are carried by a main body, and that the trigger element, having downward-facing trigger dog teeth, and the intermediate trigger element, having a downward-facing standoff surface, are carried by the load adaptor. When the tool is in the latched position, the trigger dog teeth and the trigger reaction dog pockets are configured for aligned engagement upon downward axial sliding movement of the load adaptor through its axial stroke, as urged by contact with a tubular workpiece.

An upward-facing reaction surface is also provided with the reaction dog pockets, and therefore is rigidly carried by the main body and arranged to contact the downward-facing standoff surface at an axial stroke position lower than required for engagement of the trigger dog teeth with the reaction dog pockets. The intermediate trigger element and the trigger element are coupled to each other and to the load adaptor assembly such that downward axial compressive movement or stroke of the standoff surface relative to the load adaptor from a first (land) position to a second (fully-stroked) position, as urged by contact with a tubular workpiece, will urge both rotation and upward axial movement of the trigger dog teeth.

Initially, the rotation of the trigger dog teeth is prevented by interaction with the reaction dog pockets which causes rotation of the lower rotary latch component relative to the upper rotary latch component to their unlatched position, and when the intermediate trigger element is fully stroked, the trigger dog teeth will be fully retracted and disengaged from the reaction dog pockets, and this retraction of the trigger dog teeth will support re-latching under application of external rotation in the re-latching direction. This embodiment preferably includes biasing means tending to resist both axial compression of the intermediate trigger element and retraction of the trigger element such that upon unloading and withdrawal from the tubular workpiece, the intermediate trigger and trigger elements return to their initial positions.

To further support reverse rotation under set-down load as needed to effect re-latching, the intermediate trigger may be provided as an intermediate trigger assembly comprising an intermediate trigger extension, having a downward-facing standoff surface, threaded to the intermediate trigger but rotationally keyed to the main body such that rotation in the direction of unlatching tends to move the standoff surface lower, causing compressive engagement of the standoff surface and the reaction surface at axially-higher positions, which prevents the premature engagement of the trigger dog teeth with the reaction dog pockets until the rotational position for re-latching has been reached.

BRIEF DESCRIPTION OF THE DRAWINGS

Embodiments will now be described with reference to the accompanying Figures, in which numerical references denote like parts, and in which.

DETAILED DESCRIPTION

Figure 1:
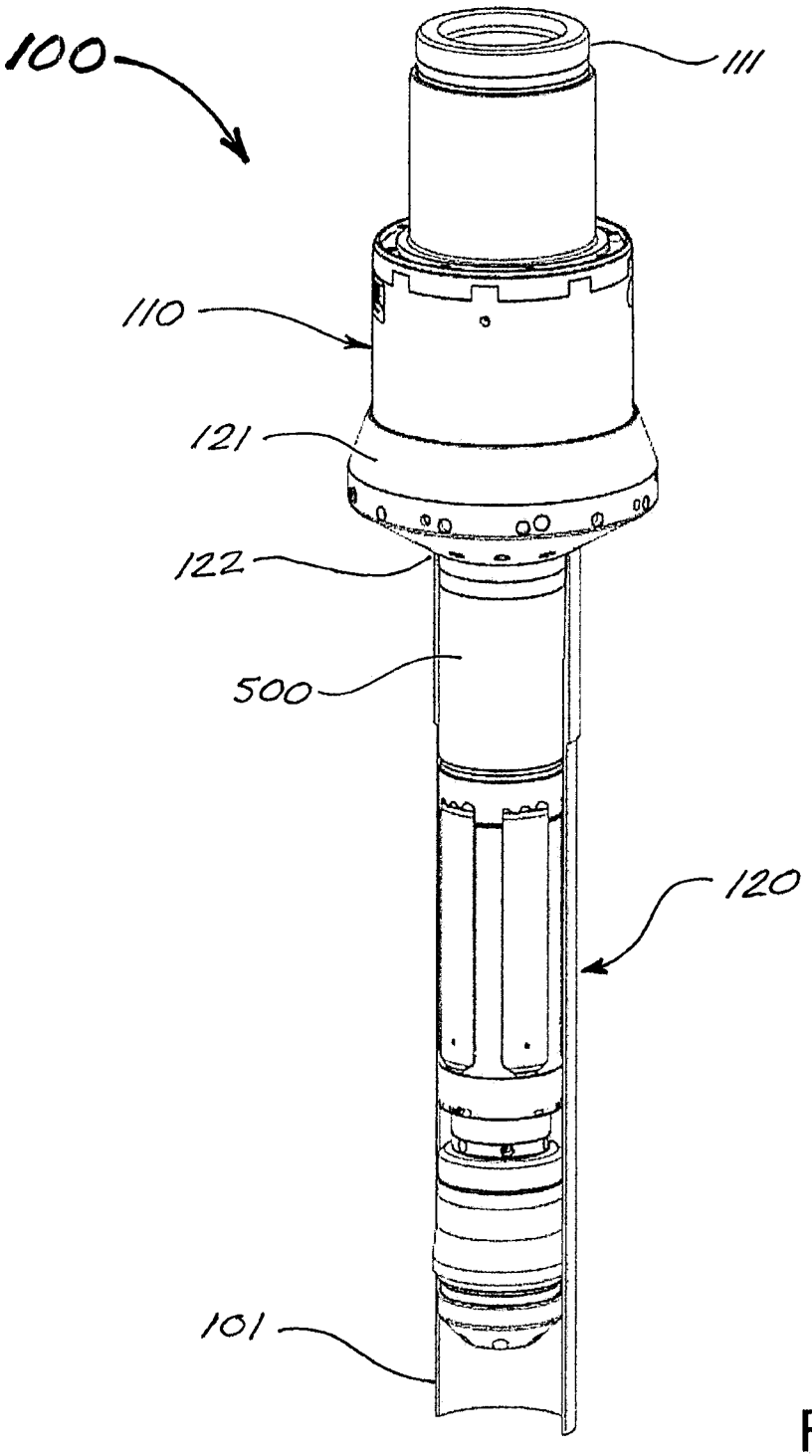
FIG. 1 (Prior Art)
FIG. 1 illustrates a prior art internally-gripping casing running tool (CRTi) as illustrated in FIGS. 8 and 9 in US 2011/0100621.

FIG. 1 illustrates a prior art internally-gripping CRT 100 essentially identical to the CRTi shown in FIGS. 8 and 9 in US 2011/0100621. CRT 100 includes a body assembly 110, a grip assembly 120, and a cage 500 linked to grip assembly 120. CRT 100 is shown in FIG. 1 as it would appear in the latched position and inserted into a tubular workpiece 101 (shown in partial cutaway). In this latched position, relative axial movement between body assembly 110 and grip assembly 120 is prevented, such that grip assembly 120 is held in its retracted position.

The upper end of body assembly 110 is provided with a load adaptor 112 (illustrated by way of non-limiting example as a conventional tapered-thread connection) for structural connection to a top drive quill (not shown) of a drilling rig (not shown). Grip assembly 120 includes a land surface 122 carried by a fixed bumper 121 rigidly attached to cage 500 of grip assembly 120. As described in US 2011/0100621 but not shown herein, body assembly 110 carries an upper rotary latch component, and grip assembly 120 carries a lower rotary latch component, which is linked to cage 500 so as to be generally fixed against rotation and axial movement relative to cage 500 when in the latched position, but configured for rotary movement to an unlatched position in response to typically right-hand rotation of body assembly 110 relative to grip assembly 120, with the latch actuation torque corresponding to this rotary movement being reacted by tractional engagement of land surface 122 with tubular workpiece 101.

Figure 2A:
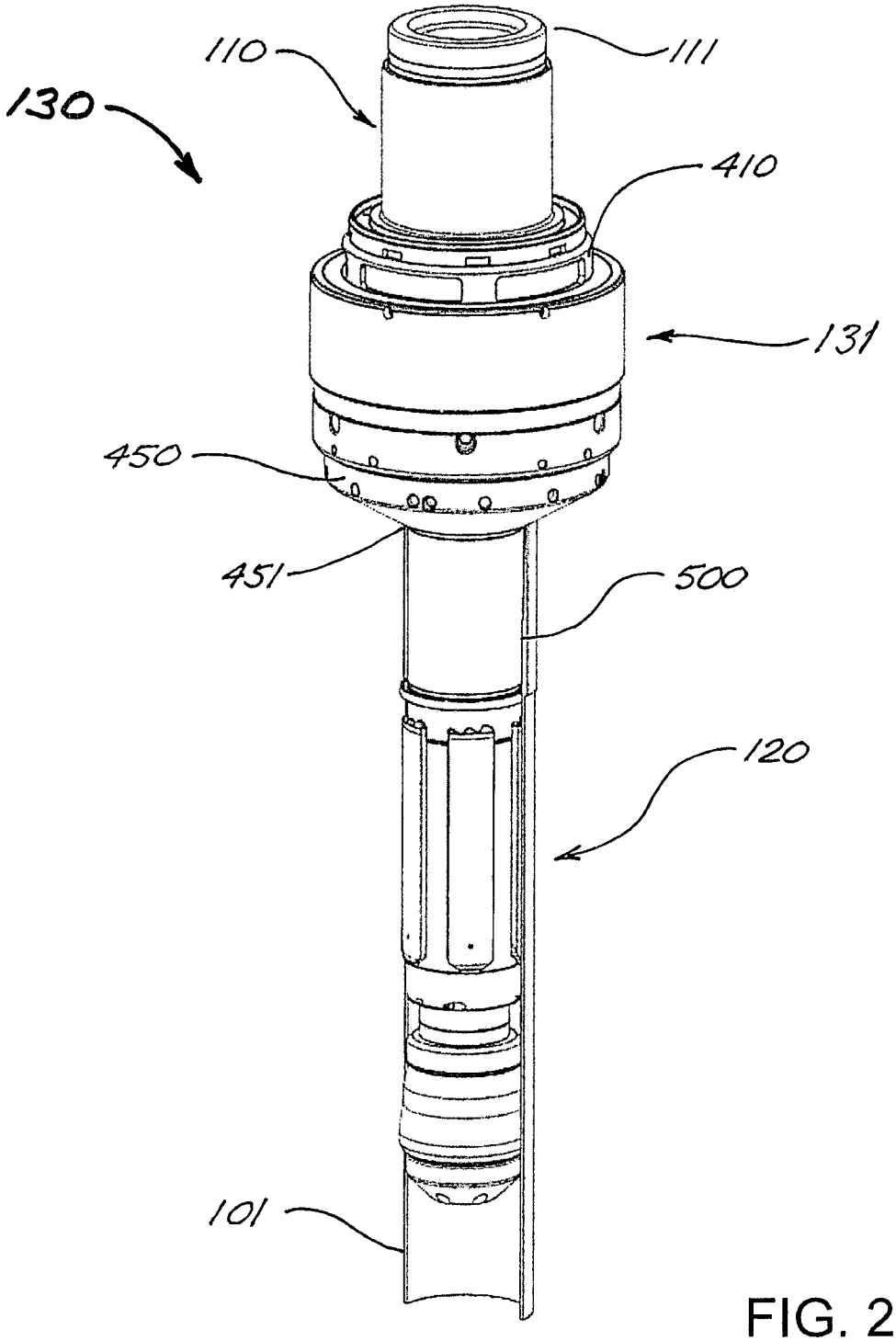
FIGS. 2A and 2B, respectively, are isometric and sectional views of a prior art CRTi as in FIG. 1, fitted with an embodiment of a latch release mechanism in accordance with the present disclosure.

FIG. 2A illustrates a CRTi 130 generally corresponding to CRT 100 in FIG. 1, but modified to incorporate an embodiment of a rotary latch release mechanism (or trigger mechanism) in accordance with the present disclosure. CRTi 130 is shown in FIG. 2A as it appears in the latched position. In this particular embodiment, CRTi 130 includes a latch release mechanism 201 comprising:

- an upper rotary latch component provided in the form of a trigger reaction ring 204 rigidly carried by body assembly 110, and having one or more downward-facing trigger reaction dog pockets 205, with each trigger reaction dog pocket 205 being generally defined by a reaction pocket load flank 206, a reaction pocket crest 207, and a reaction pocket lock flank 208;
- a trigger element 210 having one or more upward-facing trigger dog teeth 211, with each trigger dog tooth 211 being generally defined by a trigger dog tooth load flank 212, a trigger dog tooth crest 213, and a trigger dog tooth lock flank 214, wherein each trigger dog tooth 211 engages a corresponding trigger reaction dog pocket 205 when latch release mechanism 201 is in the latched position as shown in FIG. 2A; and
- a movable bumper 218 having a movable land surface 220, wherein trigger element 210 and movable bumper 218 are carried by a lower upper rotary latch component provided in the form of a cage extension 222 rigidly coupled to cage 500.

Cage extension 222, trigger element 210, and movable bumper 218 are generally configured as a coaxially-nested group of closely-fitting cylindrical components, where relative rotary and translational movements between these components are constrained to keep them coaxially aligned, but also linked by cam pairs in the manner of cam followers and cam surfaces as described later herein.

FIGS. 3A and 3B, FIGS. 4A and 4B, FIGS. 5A and 5B, FIGS. 6A and 6B, and FIGS. 7A and 7B schematically illustrate the operative relationships of the various components of latch release mechanism 201, at sequential stages of the operation of latch release mechanism 201. Although latch release mechanism 201 is a three-dimensional rotary assembly, to facilitate a clear understanding of the structure and operation of latch release mechanism 201, the basic components of latch release mechanism 201 are shown in FIGS. 3A to 7B in a generally two-dimensional schematic manner, with the tangential (rotary) direction being transposed into the horizontal direction, and with the axial direction being transposed into the vertical direction.

Figure 3A:
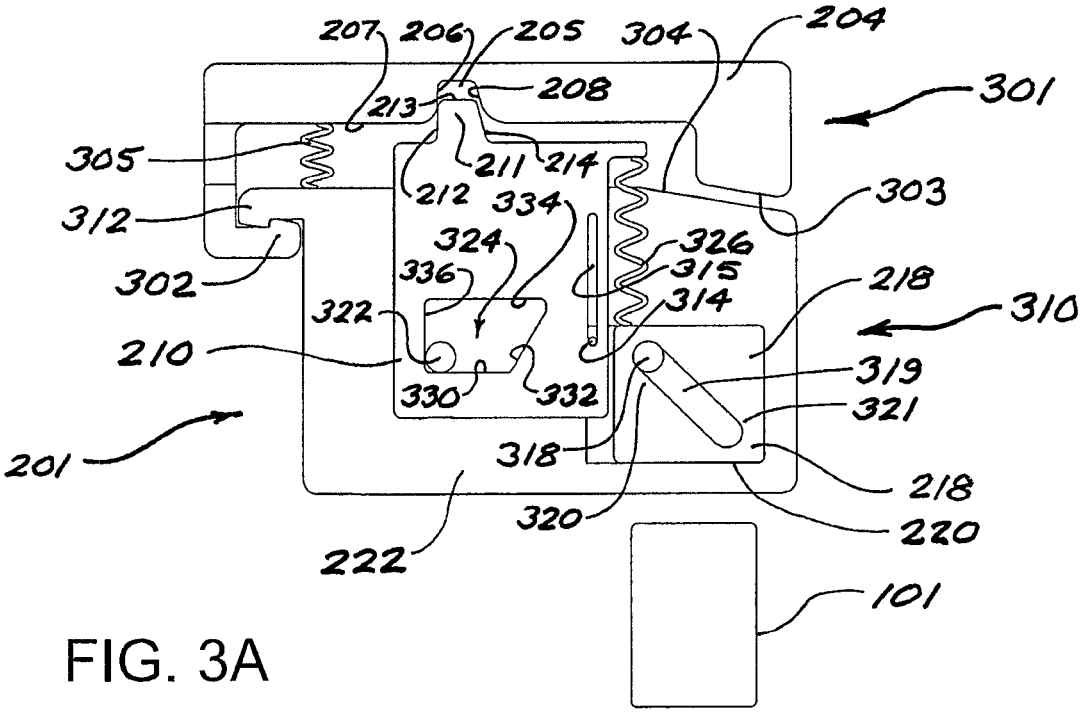
FIGS. 3A and 3B, respectively, are schematic plan and isometric views of an exemplary embodiment of a latch release mechanism in accordance with the present disclosure, shown in the latched and un-latched positions, respectively.
Figure 3B:
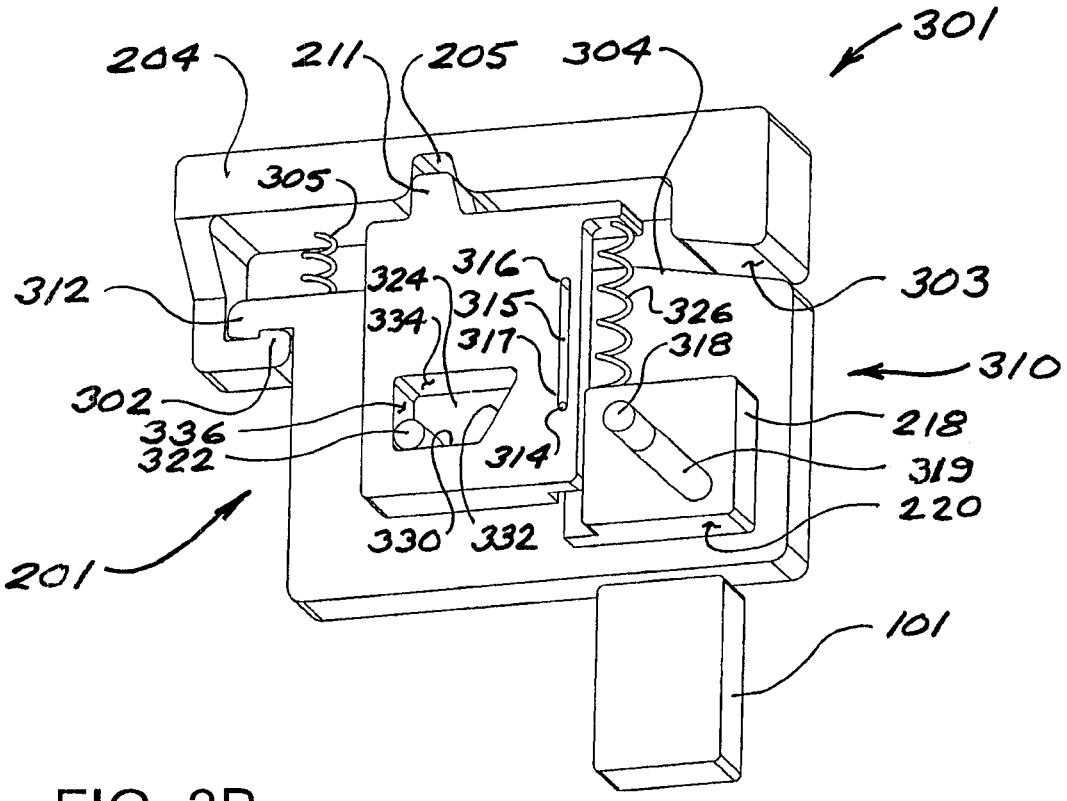

FIGS. 3A and 3B illustrate latch release mechanism 201 in relation to a schematically-represented CRT, still in the fully-latched position, with a schematically-represented tubular workpiece 101 disposed slightly below movable bumper 218. Reference number 301 represents an upper latch assembly rigidly coupled to body assembly 110 of the CRT, and having a trigger reaction dog pocket 205 and an upper rotary latch receiver 302. Reference number 310 represents a lower latch assembly comprising a cage extension 222 incorporating a lower rotary latch hook 312 shown in the latched position relative to upper rotary latch receiver 302. Upper latch assembly 301 carries an internal upper cam ramp surface 303, shown nearly in contact with an internal lower cam ramp surface 304 on cage extension 222, with an internal biasing spring 305 disposed and acting between body assembly 110 and cage extension 222. These features are shown to represent the internal reactions and forces operative between body assembly 110 and grip assembly 120 of the CRT, to facilitate an understanding the functioning of the CRT in coordination with latch release mechanism 201.

Cage extension 222 carries a movable bumper 218 having a movable land surface 220 and a trigger element 210. Movable bumper 218 is linked to trigger element 210 by a bumper-trigger cam follower 314 rigidly fixed to movable bumper 218 and movable within an axially-oriented bumper-trigger cam slot 315 formed in trigger element 210, such that movable bumper 218 is axially-movable relative to trigger element 210. A bumper-cage cam follower 318, rigidly fixed to cage extension 222, is constrained to move within a bumper-cage cam slot 319 formed in movable bumper 218 (with bumper-cage cam slot 319 having an upper end 320 and a lower end 321); and a trigger-cage cam follower 322, rigidly fixed to cage extension 222, is constrained to move within a trigger-cage cam pocket 324 provided in trigger element 210.

Notwithstanding the particular and exemplary arrangement of the components of the latch release mechanism 201 as described above and illustrated in FIGS. 3A and 3B, it will be apparent to persons skilled in the art that the choice of fixing the cam follower to one or the other of two components to be paired, and the cam profile in the other, is arbitrary with respect to the relative movement constraint, and corresponding freedom, imposed by such a linkage. Similarly, the choice of cam follower/cam surface as the means for providing the desired movement constraint is not intended to be in any way limiting. Persons skilled in the art will readily understand that generally equivalent linkages can be provided in other forms without departing from the intended scope of the present disclosure.

In the illustrated embodiment, bumper-trigger cam slot 315 is provided as an axially-oriented slot, closely fitting with the diameter of the associated bumper-trigger cam follower 314, and thus having a single degree of freedom to permit only relative axial sliding movement between trigger element 210 and movable bumper 218 but not relative rotation, with a trigger bias spring 326 being provided to act between trigger element 210 and movable bumper 218, in the direction of axial sliding, to bias movable bumper 218 downward relative to trigger element 210. Bumper-cage cam slot 319 is sloped at a selected angle relative to the vertical (shown by way of non-limiting example in FIGS. 3A and 3B as approximately 45 degrees) and is closely-fitting with the diameter of the associated bumper-cage cam follower 318 to provide a single degree of freedom linking relative axial movement of movable bumper 218 to rotation of cage extension 222. However, free movement of trigger-cage cam follower 322 is permitted within the trapezoidal trigger-cage cam pocket 324, constrained only by contact against cam constraint surfaces defining the perimeter of trigger-cage cam pocket 324, as follows:

- a trigger advance cam surface 330, defining a horizontal lower edge of trigger-cage cam pocket 324;
- a trigger withdraw cam surface 332, defining a sloped right-side edge of trigger-cage cam pocket 324, sloped at a selected angle from the vertical;
- a trigger re-latch cam surface 334, defining a horizontal upper edge of trigger-cage cam pocket 324; and
- a trigger reset cam surface 336, defining a vertical left-side edge of trigger-cage cam pocket 324.

During typical operations, the operative status of latch release mechanism 201 may be characterized with reference to the position of trigger-cage cam follower 322 within trigger-cage pocket 324, as follows:

- Start position: with trigger-cage cam follower 322 proximal to the intersection of trigger reset cam surface 336 and trigger advance cam surface 330 (as seen in FIGS. 3A, 3B, 4A, and 4B);
- Advanced position: with trigger-cage cam follower 322 proximal to the intersection of trigger advance cam surface 330 and trigger withdraw cam surface 332 (as in seen FIGS. 5A and 5B);
- Withdrawn position: with trigger-cage cam follower 322 proximal to the intersection of trigger withdraw cam surface 332 and trigger re-latch cam surface 334; and
- Reset position: with trigger-cage cam follower 322 proximal to the intersection of trigger re-latch cam surface 334 and trigger reset cam surface 336.

When latch release mechanism 201 is in the latched position (as shown in FIGS. 3A and 3B), bumper-cage cam follower 318 is positioned toward upper end 320 of bumper-cage cam slot 319, and trigger-cage cam follower 322 is held at urged toward the start position within trigger-cage cam pocket 324 by trigger spring 326. At the same time, trigger spring 326 maintains the engagement of trigger dog tooth 211 within trigger reaction dog pocket 205, which engagement can position trigger dog tooth lock flank 214 in close opposition with lock flank 208 of trigger reaction dog pocket 205, as in this illustrated embodiment, so as to prevent accidental rotation of upper rotary latch assembly 301 relative to lower rotary latch assembly 310 as controlled by the selection of the mating flank angle and gap. Where a more vertically-inclined angle is selected to more strongly resist rotation for a given trigger bias spring 326 force.

It will be apparent that upper rotary latch receiver 302 and lower rotary latch hook 312, configured as a J-slot requiring axial displacement, already provides some protection against accidental rotation. However, for the type of J-latch typically employed in CRTs where axial displacement is not required and unlatching with only torque is allowed, the trigger dog tooth lock flank 214 and mating reaction pocket lock flank 208 provide the additional benefit of protection against accidental rotation.

In actual operation of the rotary latch release mechanism, the contact force reacted by tubular workpiece 101 against movable land surface 220 tends to build as CRT 130 is lowered. However, as a matter of convenience for purposes of illustration in FIGS. 3A to 7B, upper latch assembly 301 will be considered as the datum, with workpiece 101 being viewed as tending to move upward relative to upper latch assembly 301, and correspondingly tending to urge movable land surface 220 upward (rather than downward as in actual operation).

Figure 4A:
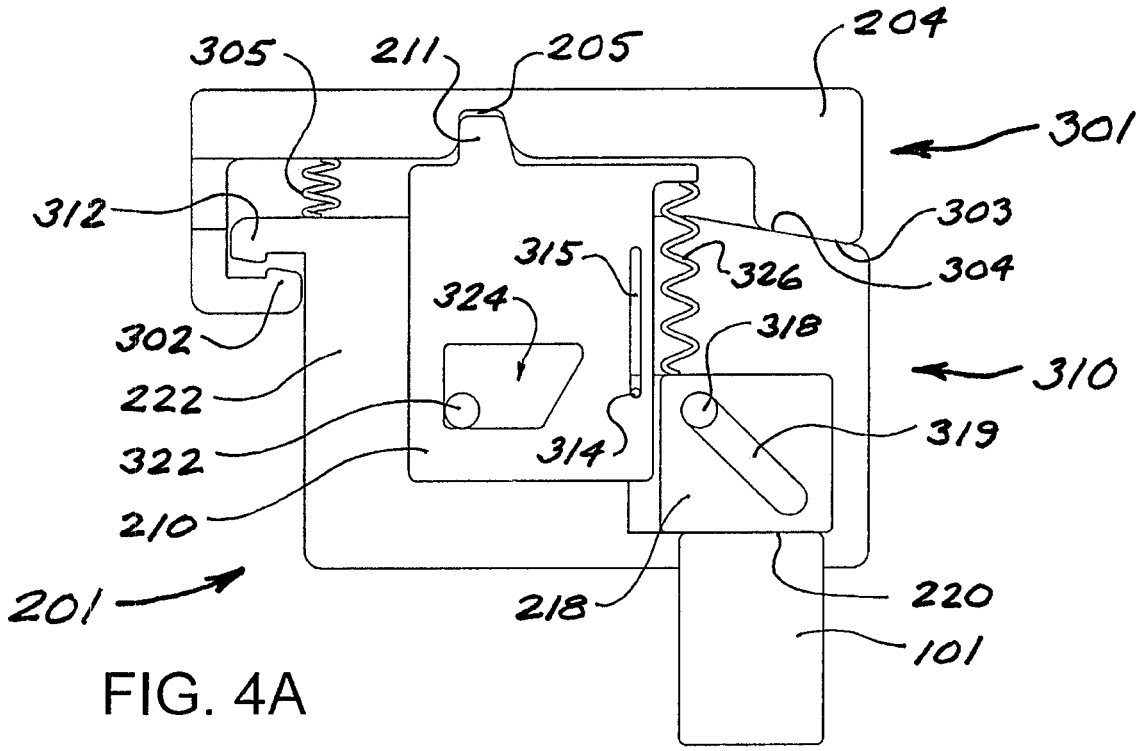
FIGS. 4A and 4B, respectively, are schematic plan and isometric views of the latch release mechanism in FIGS. 3A and 3B, shown after the application of axial load causing axial movement to initiate a latch release sequence.
Figure 4B:
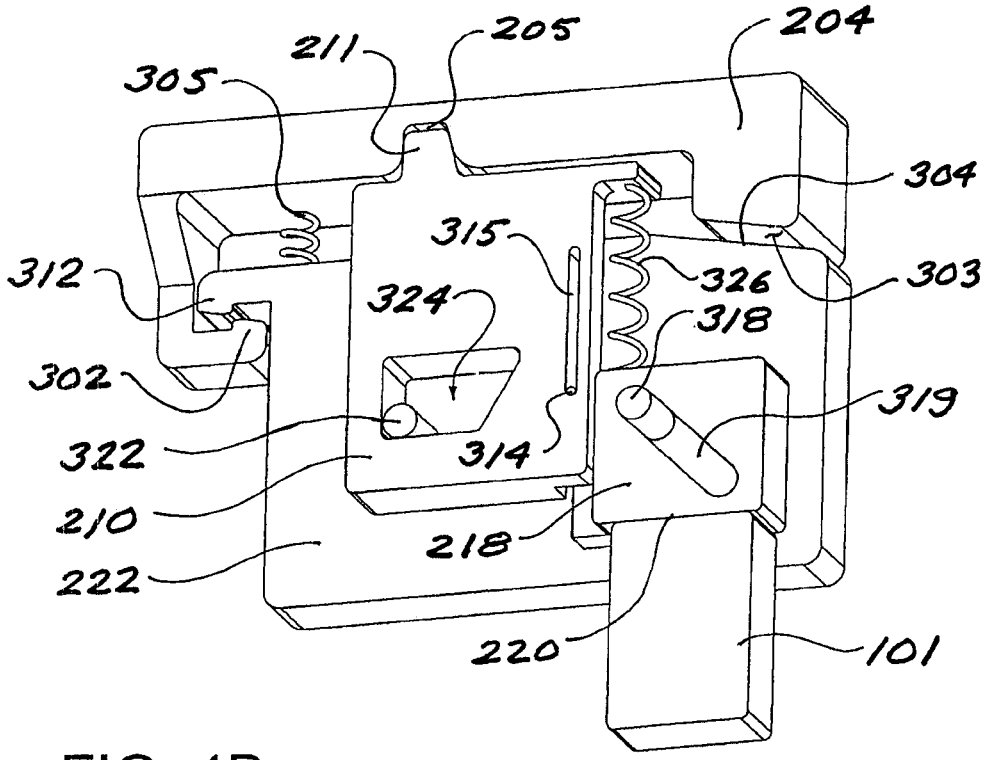

Referring now to FIGS. 4A and 4B, where the force of trigger bias spring 326 is sufficient to prevent relative movement between the components of latch release mechanism 201, force applied to movable land surface 220 will be transmitted through to cage extension 222, with upward movement being resisted until the force of internal bias spring 305 is overcome, resulting in upward movement of the entire lower latch assembly 310, and correspondingly moving lower rotary latch hook 312 axially upward relative to upper rotary latch receiver 302. This upward movement is restricted by contact between internal upper cam ramp surface 303 and internal lower cam ramp surface 304, as illustrated in FIGS. 4A and 4B.

While such upward movement causing axial separation of lower rotary latch hook 312 from upper rotary latch receiver 302 is not a required movement for the type of J-latch typically employed for all CRTs, as will be known to persons skilled in the art, mating latch hook 312 and latch receiver 302 can be alternatively configured to disengage in response to applied torque only.

Figure 5A:
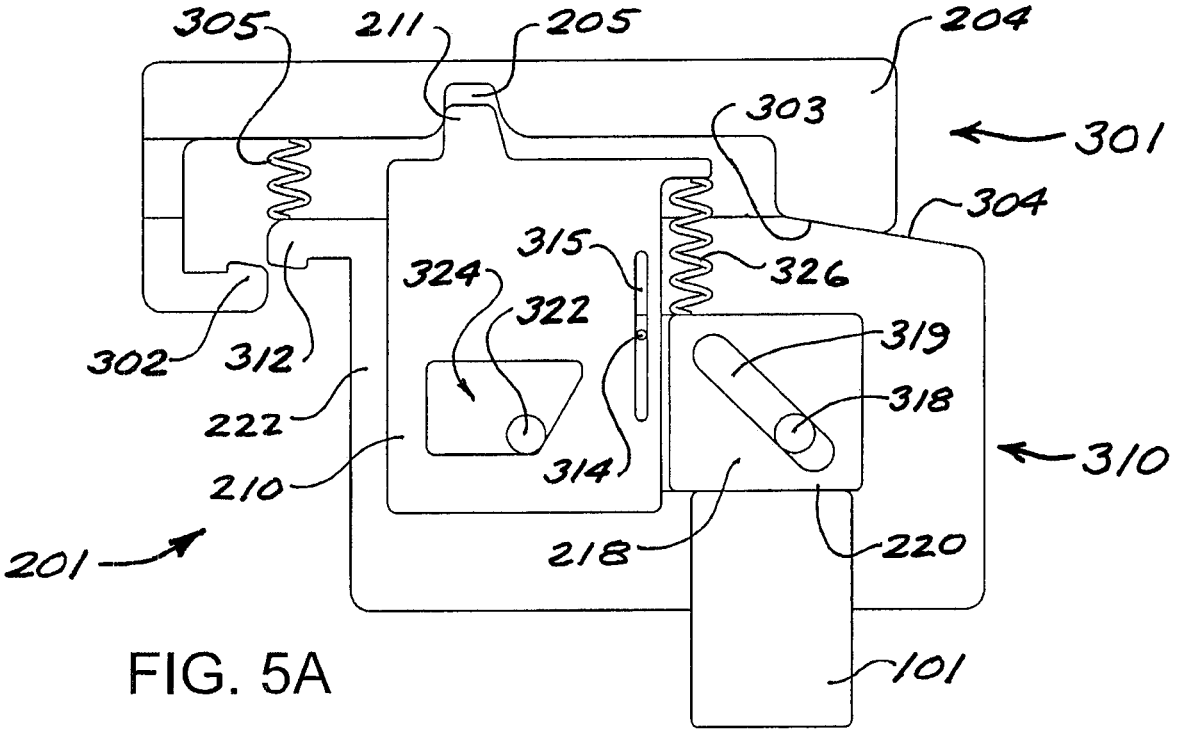
FIGS. 5A and 5B, respectively, are schematic plan and isometric views of the latch release mechanism in FIGS. 3A and 3B, shown after application of axial load to stroke the latch release mechanism so as to cause rotary movement sufficient to release the latch.
Figure 5B:
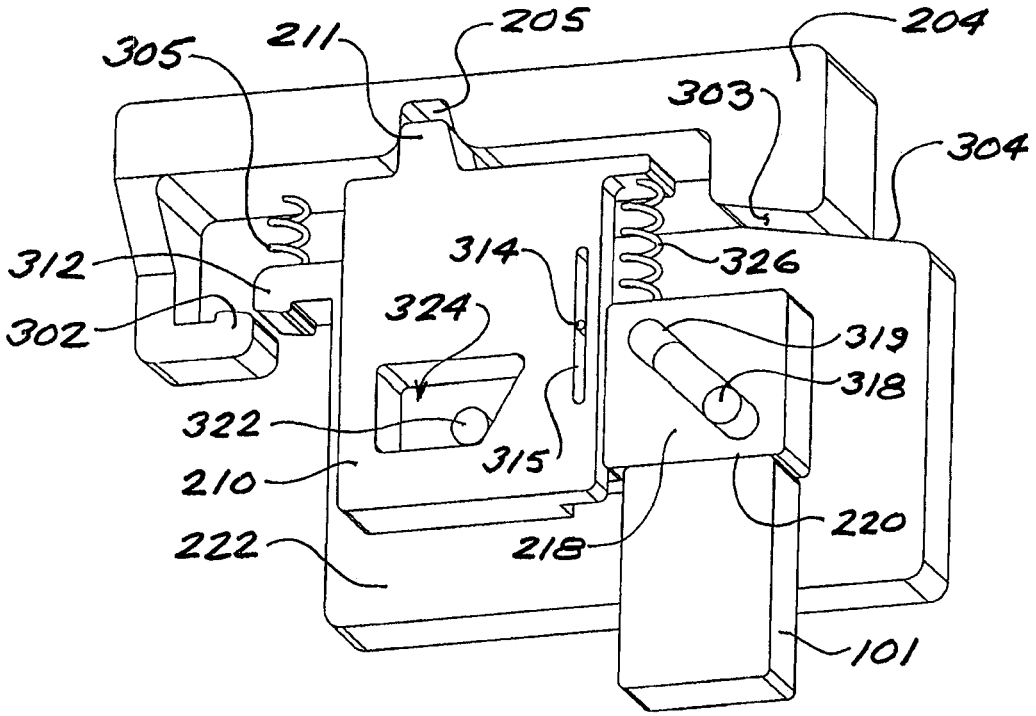

Independent of whether the applied load is first sufficient to overcome the force of the internal bias spring, when sufficient force is applied by workpiece 101 to overcome the force of trigger bias spring 326, movable bumper 218 will move upward, causing bumper-cage cam follower 318 to move downward within sloped bumper-cage cam slot 319, as shown in FIGS. 5A and 5B. The upward movement of movable bumper 218 tends to cause rotation of cage extension 222, but such rotation is resisted by the actuation torque acting between upper latch assembly 301 and lower latch assembly 301 and 310. This torque is transferred through movable bumper 218 to trigger element 210 via bumper-trigger cam follower 318 and cam slot 319, and through trigger dog tooth load flank 212 to reaction pocket load flank 206 and thence back to upper latch assembly 301, thus internally reacting the latch actuation torque and causing trigger-cage cam follower 322 to move along trigger advance cam surface 330 to the advanced position within trigger-cam pocket 324, thus moving the rotary latch to its unlatched position as shown in FIGS. 5A and 5B. This movement is illustrated as right-hand rotation of upper latch assembly 301 relative to lower latch assembly 310.

Figure 6A:
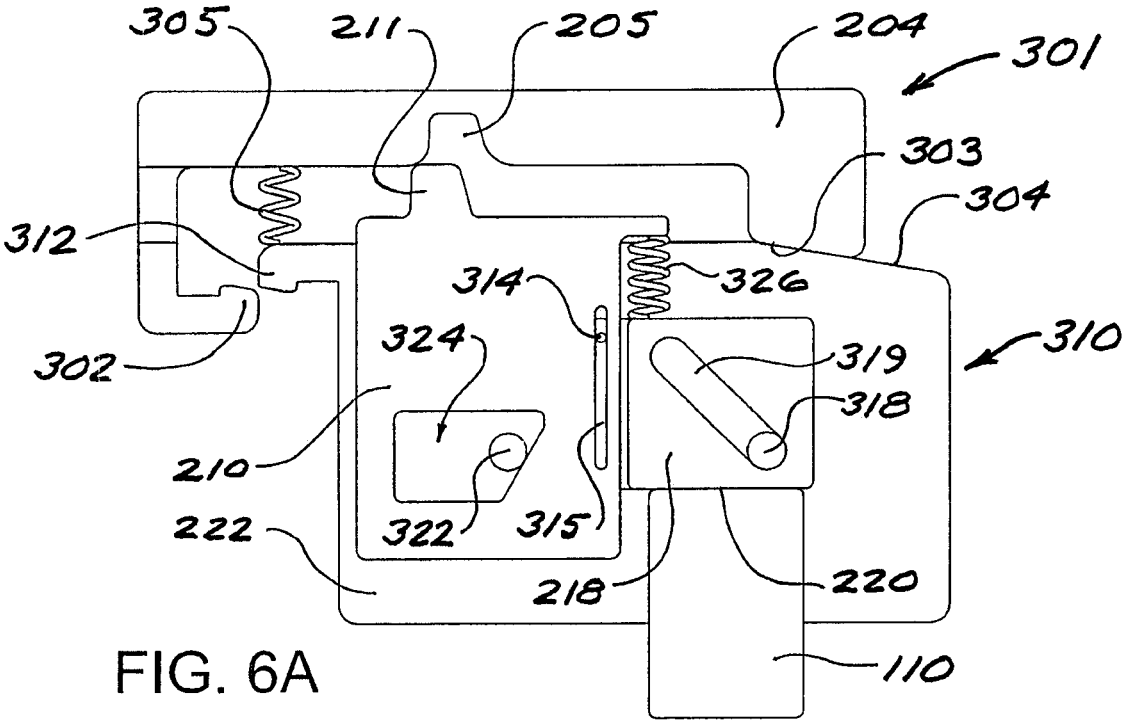
FIGS. 6A and 6B, respectively, are plan and isometric views of the latch release mechanism in FIGS. 3A and 3B, shown after application of axial load to stroke the latch release mechanism so as to cause axial movement sufficient to withdraw the latch.
Figure 6B:
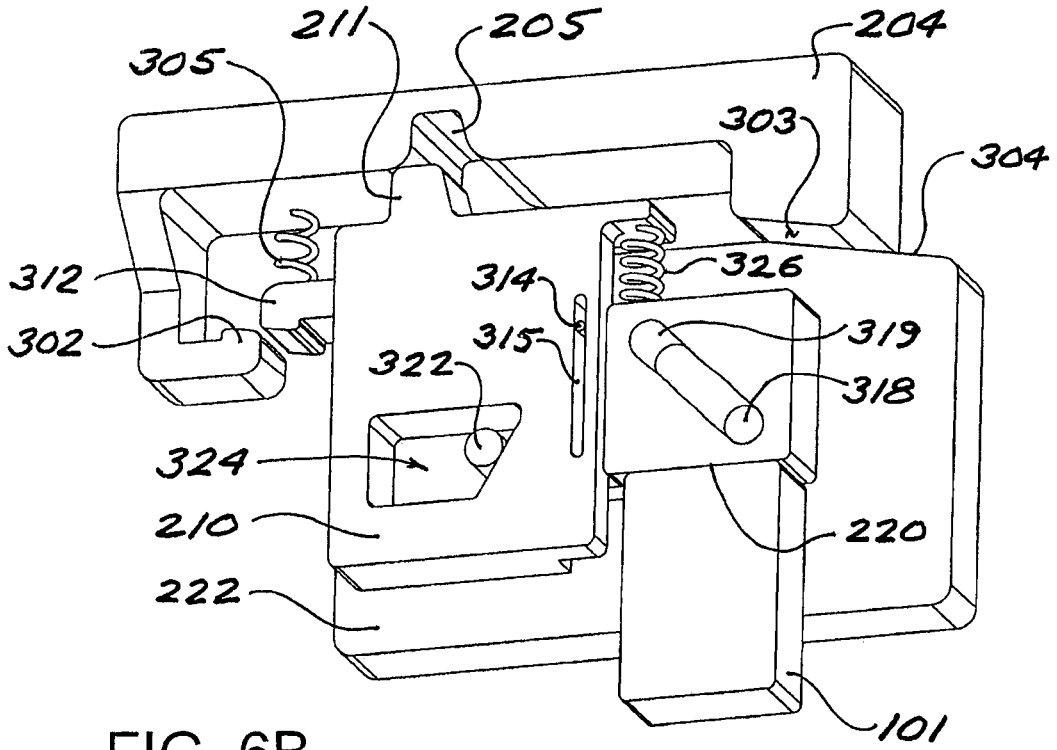

As may be seen with reference to FIGS. 6A and 6B, further upward movement of movable bumper 218 continues to urge rotation of cage extension 222, causing movement of trigger-cage cam follower 322 to the withdrawn position within trigger-cam pocket 324, resultant downward movement of trigger element 210, and corresponding withdrawal of trigger dog tooth 211 from engagement with trigger reaction dog pocket 205. The slope angle of trigger withdraw cam surface 332 of trigger-cam pocket 324 is selected relative to the orientation of bumper-cage cam slot 319 to promote the withdrawal of trigger dog tooth 211 without jamming or otherwise inducing excess force considering the operative trigger bias spring 326 force and frictional forces otherwise tending to affect the withdrawal movement. Furthermore, it will be apparent that with trigger element 210 withdrawn from trigger reaction ring 204, upper rotary latch assembly 301 is free to rotate relative to the lower rotary latch assembly 310, and, more specifically, allows left-hand rotation of upper latch assembly 301 relative to lower latch assembly 310 to re-latch the tool.

This rotation supports movement of lower rotary latch hook 312 into engagement with upper rotary latch receiver 302 (i.e., the latched position), with corresponding actuation torque being resisted by tractional engagement of movable land surface 220 with tubular workpiece 101. In general, though, the portion of the set-down load carried by contact between internal upper cam ramp surface 303 and internal lower cam ramp surface 304, as a function of the associated cam ramp angle, tends to require less tractional engagement for this re-latching movement than required for unlatching in tools having different types of latch release mechanisms.

Figure 7A:
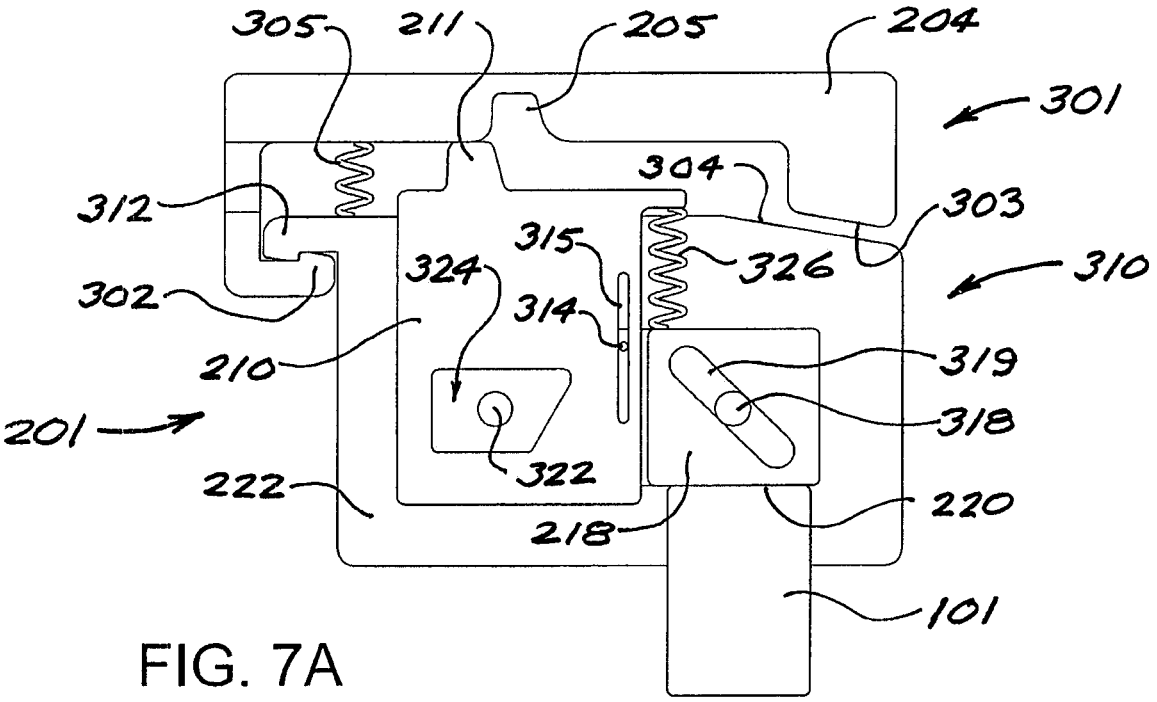
FIGS. 7A and 7B, respectively, are plan and isometric views of the latch release mechanism in FIGS. 3A and 3B, shown after rotation to re-latch the latch, and after sufficient reduction of axial load to partially reset the latch release mechanism.
Figure 7B:
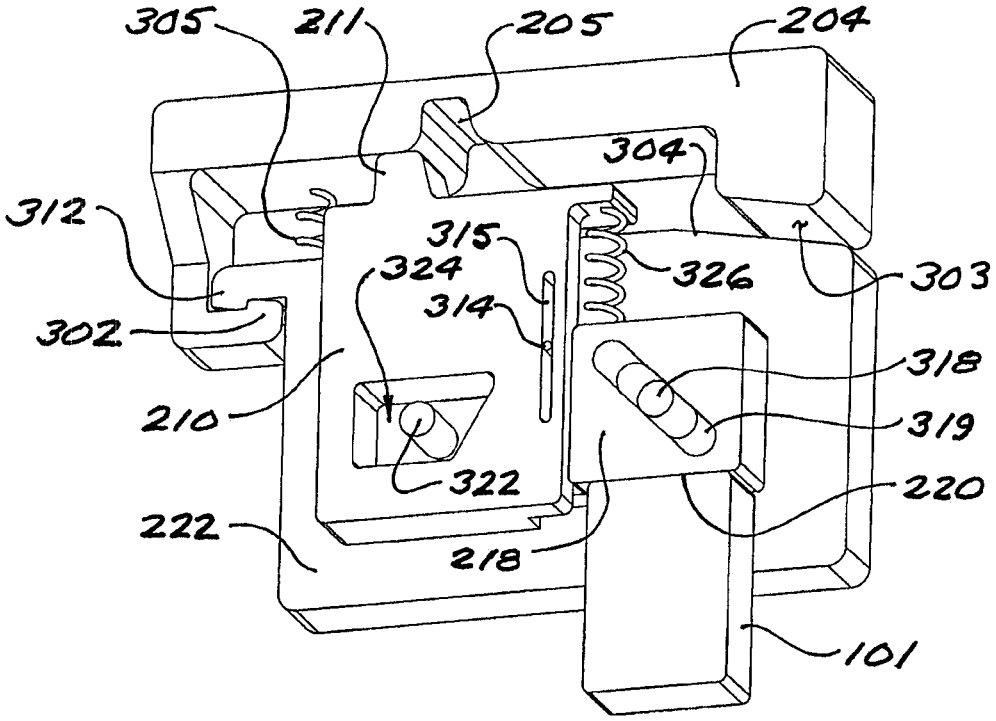

Referring now to FIGS. 7A and 7B, it will be seen that as the operational step to remove the tool from tubular workpiece 101 causes a reduction of the upward axial force acting on movable land surface 220, trigger bias spring 326 urges movable bumper 218 downward and correspondingly causing rotation of movable bumper 218 relative to cage extension 222, possibly with associated sliding at the interface between movable land surface 220 and tubular workpiece 101, and resultant tractional frictional force acting in the direction to maintain latching. This movement of movable bumper 218 and the force from trigger bias spring 326 tend to urge trigger element 210 to reverse the withdrawal movement just described, moving trigger dog tooth 211 upward. However, this upward movement is prevented when trigger dog tooth crest 213 slidingly engages reaction pocket crest 207, forcing trigger-cage cam follower 322 to move from the withdrawn position toward the reset position within trigger-cage cam pocket 324. As movable bumper 218 continues to move downward, following the movement of workpiece 101, a point is reached where trigger dog tooth crest 213 no longer engages (i.e., slides off) reaction pocket crest 207, thereby allowing trigger-cage cam follower 322 to move from the reset position and back toward the start position within trigger-cage cam pocket 324, thus returning the latch release mechanism 201 to the operational state shown in FIGS. 3A and 3B, in which the tool is once again ready to initiate the operational sequence illustrated in FIGS. 3A and 3B through 7A and 7B.

CRTi Embodiment

Figure 2B:
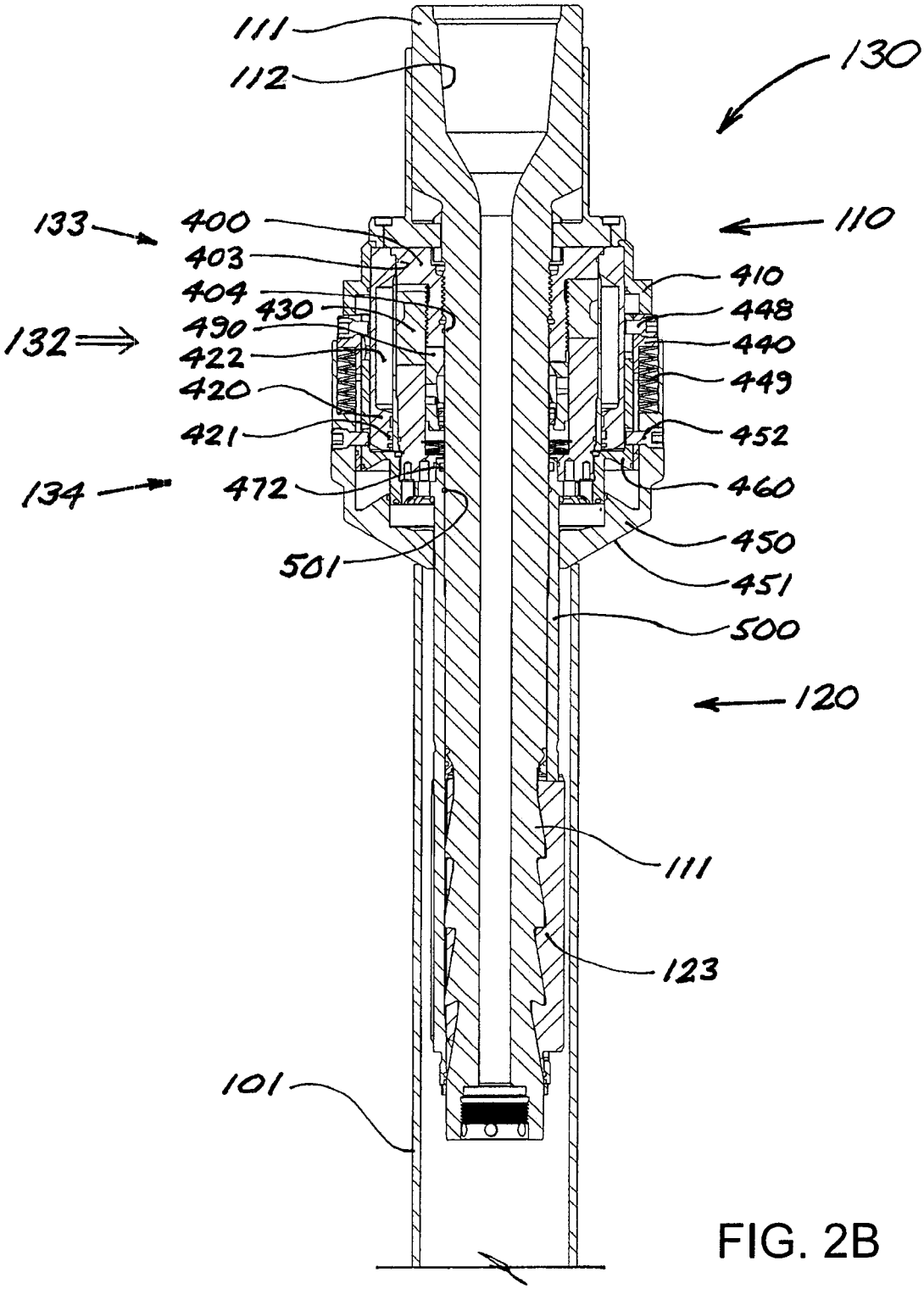

FIG. 2B illustrates an internally-gripping casing running tool (CRTi) 130 modified to incorporate an exemplary embodiment of a latch release mechanism 131 in accordance with the present disclosure, and a tri-cam latching linkage 132 generally as disclosed in U.S. Pat. No. 7,909,120. FIGS. 8A and 8B, FIGS. 9A and 9B, FIGS. 10A and 10B, and FIGS. 11A and 11B illustrate sequential operational stages of latch release mechanism 131.

In the embodiment illustrated in FIG. 2B, modified CRTi 130 comprises a body assembly 110 incorporating a mandrel 111 having a load adaptor 112 for structural connection to the top drive quill of a drilling rig (not shown), a grip assembly 120 comprising a cage 500 and jaws 123, latch release mechanism 131, and tri-cam latching linkage 132. Tri-cam latching linkage 132 comprises an upper latch assembly 133 fixed to and carried by body assembly 110, and a lower latch assembly 134 fixed to and carried by grip assembly 120.

Figure 8A:
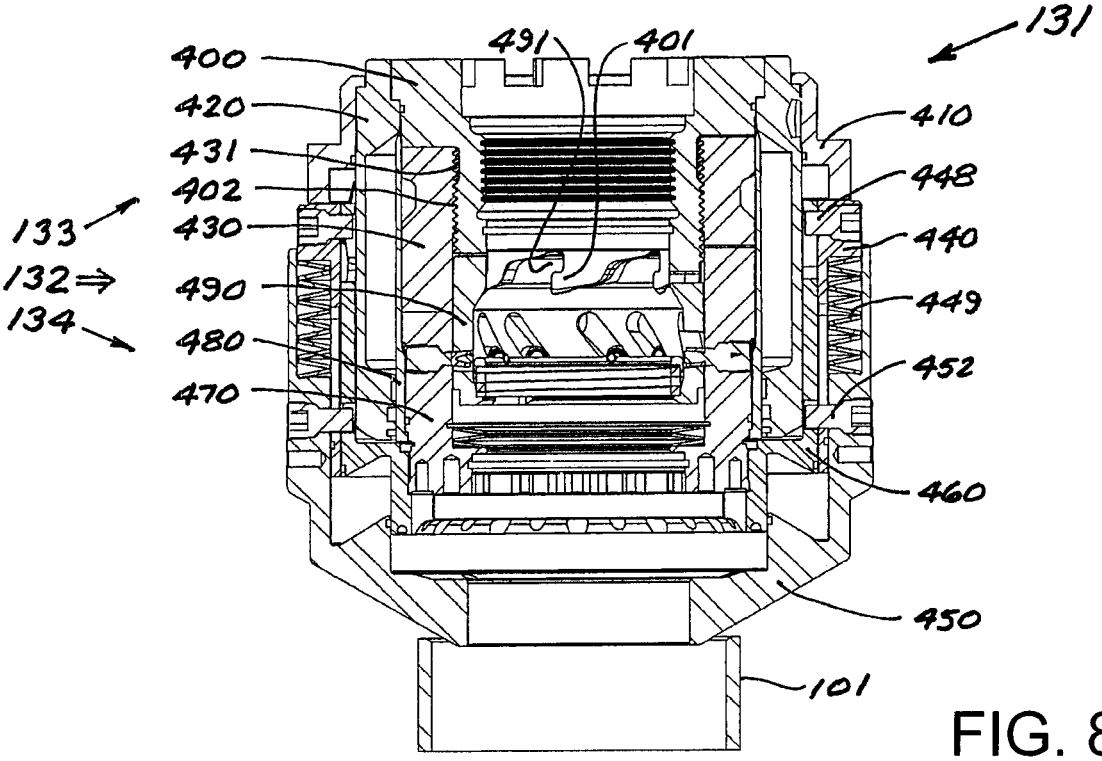
FIG. 8A is a cross-section through the tri-cam latching linkage and latch release mechanism of the modified CRTi tool in FIGS. 2A and 2B, shown in the latched and unloaded position.
Figure 9A:
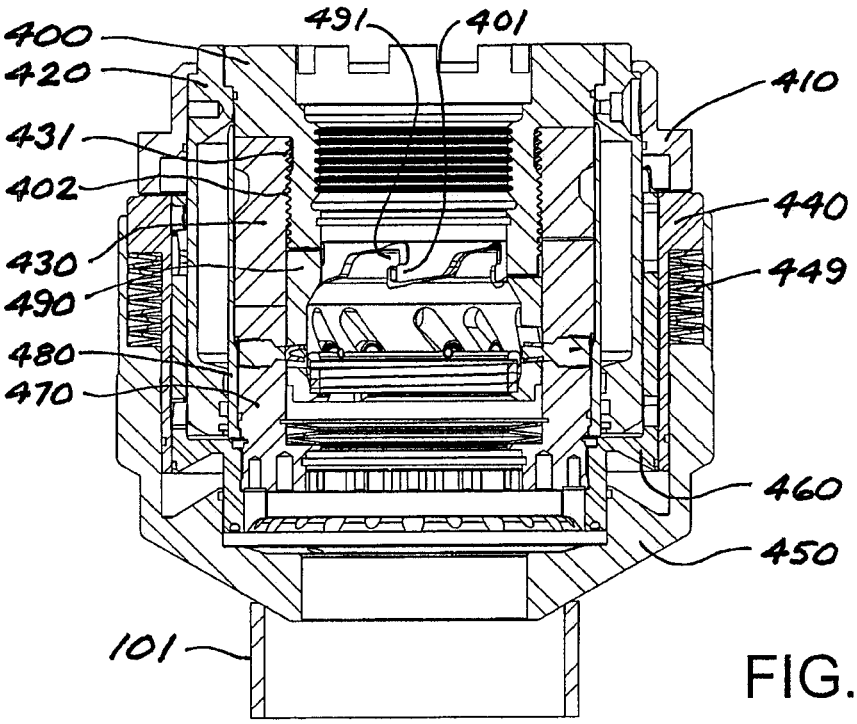
FIG. 9A is a cross-section through the tri-cam latching linkage and latch release mechanism as in FIG. 8A, shown after application of axial load to stroke the latch release mechanism so as to cause rotary movement sufficient to release the latch.

As illustrated in FIG. 8A, latch release mechanism 131 includes an upper latch assembly 133 comprising a drive cam body 400 carrying a plurality of drive cam latch hooks 401, and a drive cam housing 420, with drive cam body 400 being rigidly constrained to body assembly 110 of CRTi 130. Latch release mechanism 131 further includes a lower latch assembly 134 comprising a driven cam body 470, a driven cam housing 480, and a latch cam 490, with latch cam 490 having a plurality of latch cam latch hooks 491, and being rigidly constrained to grip assembly 120 of CRTi 130.

A drive cam body-housing seal 403, a drive cam body-mandrel seal 404, a drive housing-driven housing seal 421, a drive cam body-cage seal 472, and a cage mandrel seal 501 define an annular piston area and a gas spring chamber 422. When pressurized with a gas, gas spring chamber 422 forms an internal gas spring that tends to urge the separation of upper latch assembly 133 and lower latch assembly 134, thereby tending to urge separation of body assembly 110 and grip assembly 120 to move latch release mechanism 131 between a first (unlatched) position and a second (latched) position. Such separation is resisted by matingly-engageable drive cam latch hooks 401 and latch cam latch hooks 491, which can be disengaged by the application of sufficient right-hand torque (i.e., latch actuation torque) and corresponding right-hand rotation of body assembly 110 relative to grip assembly 120. Tri-cam latching linkage 132 is considered to be in the latched position when drive cam latch hooks 401 and latch cam latch hooks 491 are engaged, and in the unlatched position when drive cam latch hooks 401 and latch cam latch hooks 491 are disengaged.

Figure 8B:
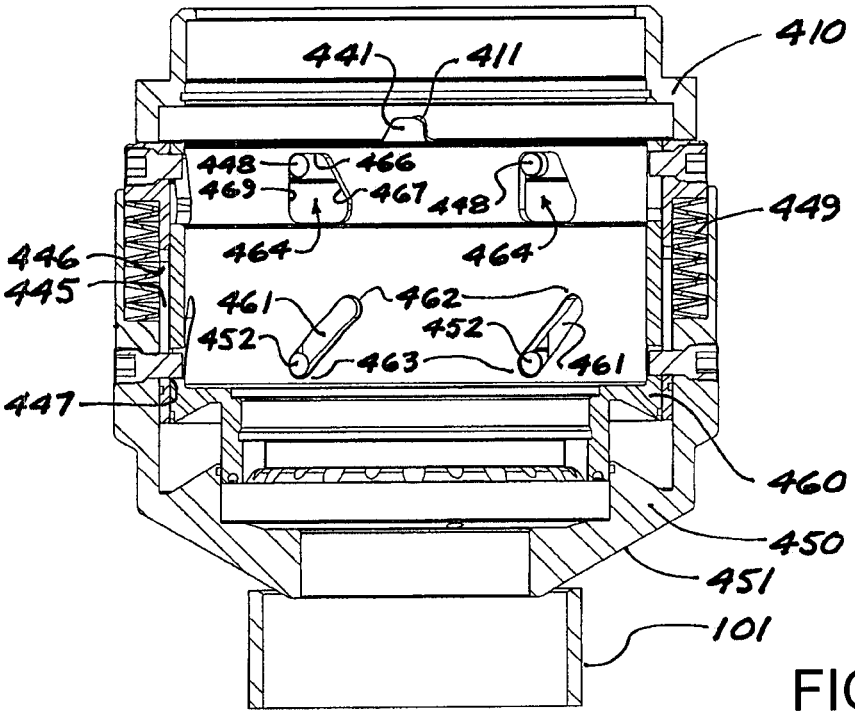
FIG. 8B is a cross-section through the latch release mechanism of the modified CRTi tool in FIGS. 2A and 2B, shown in the latched and unloaded position.

The following section details a mechanism that can be employed to use only axial compression and corresponding axial displacement to generate the right-hand torque and rotation required to unlatch the tri-cam latching linkage 132, having reference to FIG. 8B, which is a cross-section through latch release mechanism 131 shown in the latched position. For purposes of the discussion of this mechanism, the body assembly 110 will be considered as the datum, and the tubular workpiece 101 will be viewed as tending to move upward.

As illustrated in FIG. 8B, latch release mechanism 131 comprises a trigger reaction ring 410 fixed to body assembly 110, a trigger element 440, a trigger bias spring 449, a movable bumper 450 having a movable land surface 451, a bumper cam follower 452, and a cage extension 460 fixed to grip assembly 120. The components of latch release mechanism 131 and tri-cam latching linkage 132 are generally configured as a coaxially-nested group of closely-fitting cylindrical components, with relative rotary and translational movements between these components being constrained to first maintain them coaxially aligned.

In operation, CRTi 130 with latch release mechanism 131 would first be inserted or "stabbed" into tubular workpiece 101 and lowered until movable land surface 451 contacts tubular workpiece 101, and the contact force resulting from tool weight and set-down load applied by the top drive (not shown) increases above the "trigger set-down load", at which point latch release mechanism 131 has applied the required latch actuation torque and the displacement required to disengage drive cam latch hooks 401 and latch cam latch hooks 491. The gas spring will cause axial displacement of body assembly 110 relative to grip assembly 120, transitioning the CRTi tool 130 with latch release mechanism 131 from the retracted position to the engaged position. This operational sequence differs from prior art CRTi 100 in two ways:

First, CRTi 130 with latch release mechanism 131 does not require externally-applied right-hand rotation to transition between the retracted and engaged positions, which simplifies the operational procedure.

Second, latch release mechanism 131 is designed such that it does not rely on tractional engagement between movable land surface 451 and tubular workpiece 101; instead, the latch actuation torque is internally reacted, thus reducing operational uncertainty.

Figure 10A:
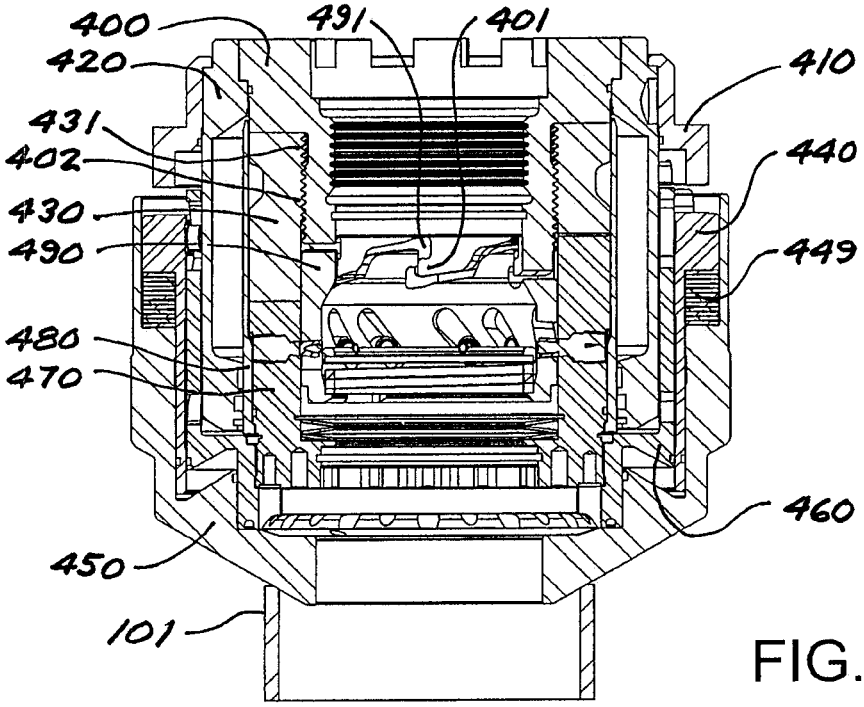
FIG. 10A is a cross-section through the tri-cam latching linkage and latch release mechanism in FIG. 8A, shown after the application of sufficient axial load to stroke the latch release mechanism so as to withdraw the trigger dog.
Figure 10B:
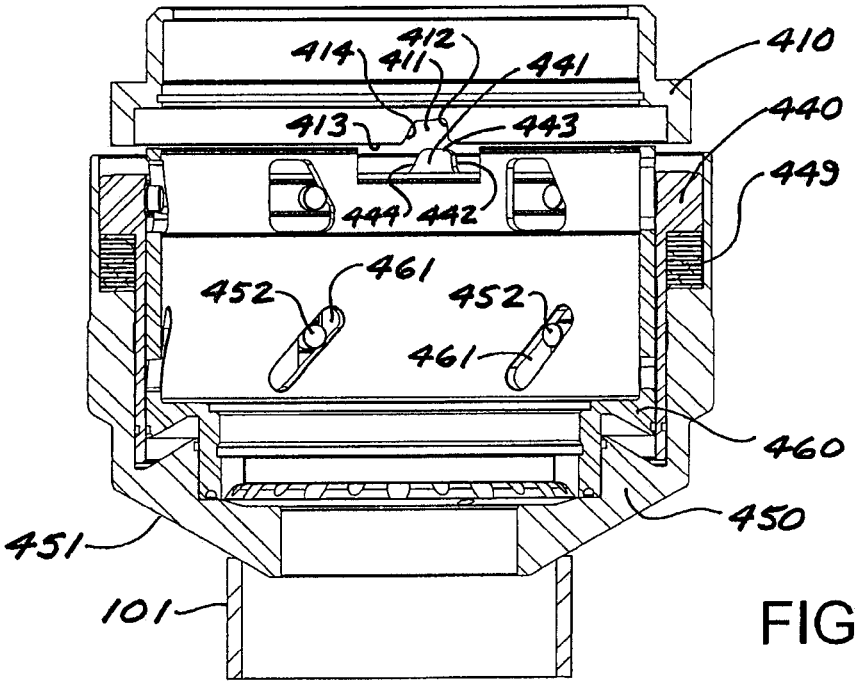
FIG. 10B is a cross-section through the latch release mechanism in FIG. 8B, shown after the application of sufficient axial load to stroke the latch release mechanism so as to withdraw the trigger dog.

As best understood with reference to FIG. 10B, trigger reaction ring 410 has one or more downward-facing trigger reaction dog pockets 411, each of which is generally defined by a reaction pocket load flank 412, a reaction pocket crest 413, and a reaction pocket lock flank 414, with each trigger reaction dog pocket 411 being engageable with a corresponding upward-facing trigger dog tooth 441. Each trigger dog tooth 441 is generally defined by a trigger dog tooth load flank 442, a trigger dog tooth crest 443, and a trigger dog tooth lock flank 444 (when the tool is in the latched position as shown in FIG. 8B). Movable bumper 450 and trigger element 440 are linked by bumper cam follower 452, fixed to movable bumper 450 and movable within a trigger cam slot 445 provided in trigger element 440, between an upper end 446 and a lower end 447 of trigger cam slot 445. Additionally, movable bumper 450 is linked to cage extension 460 by bumper cam follower 452, which is constrained to move within a bumper-cage cam slot 461 between an upper end 462 and a lower end 463 thereof. Trigger element 440 is linked to cage extension 460 by a trigger cam follower 448, which is fixed to trigger element 440 and is constrained to move within a cage cam pocket 464 provided in cage extension 460. Additionally, cage extension 460 is rigidly fixed to driven cam body 470.

It will be apparent to persons skilled in the art that the cam follower can be fixed to either of the two components to be paired, with the cam profile defined in the other of the two paired components, and that the design choice in this regard will typically be based on practical considerations such as efficient assembly, disassembly and maintenance. Similarly, the choice of cam follower/cam surface as the means for providing the desired movement constraint is not intended to be in any way limiting, where persons skilled in the art will understand generally equivalent linkages can be provided in other forms.

In the embodiment shown in FIG. 8B, trigger cam slot 445 is provided as an axially-oriented slot, closely fitting with bumper cam follower 452, and thus generally providing a single degree of freedom to permit relative axial movement between trigger element 440 and movable bumper 450, but not permitting relative rotation. Trigger bias spring 449 is provided to act between trigger element 440 and movable bumper 450 in the direction of axial sliding, to bias movable bumper 450 downward. Bumper-cage cam slot 461 is sloped at a selected angle relative to the vertical (shown by way of non-limiting example in FIG. 8B as approximately 45 degrees), and is closely-fitting with the associated bumper cam follower 452 to provide a single degree of freedom linking relative axial movement of movable bumper 450 to rotation of cage extension 460. However, free movement of trigger cam follower 448 is permitted within trapezoidal cage cam pocket 464, constrained only by contact against cam surfaces defining the perimeter of cage cam pocket 464, as follows:

an advance cam surface 466, defining a flat upper edge of cage cam pocket 464;

a withdraw cam surface 467, forming a helical path; and a reset cam surface 469, defining an axially-oriented side edge of cage cam pocket 464.

During typical operations, the operative status of latch release mechanism 131 may be characterized with reference to the position of trigger cam follower 448 within trigger-cage pocket 424, as follows:

Start position: with trigger cam follower 448 proximal to the intersection of cam surface 469 and advance cam surface 466;

Advanced position: with trigger cam follower 448 proximal to the intersection of cam surface 466 and withdraw cam surface 467;

Withdrawn position: with trigger cam follower 448 proximal to withdraw cam surface 467; and Reset position: with trigger cam follower 448 proximal to reset cam surface 469.

With the latch release mechanism in the latched position as in FIG. 8B, with bumper cam follower 452 positioned at lower end 463 of cage cam slot 461, trigger bias spring 449 will urge trigger cam follower 448 toward the start position within cage cam pocket 464, while simultaneously maintaining the engagement of trigger dog teeth 441 within corresponding trigger reaction dog pockets 411. This engagement of trigger dog teeth 441 disposes trigger dog tooth lock flanks 444 in close opposition to corresponding reaction pocket lock flanks 414 so as to prevent accidental rotation of upper latch assembly 133 relative to lower latch assembly 134 as controlled by the selection of the mating flank angle and gap. If necessary, a more axially-aligned camming surface may be selected to more strongly resist rotation for a given force exerted by trigger bias spring 449.

Figure 9B:
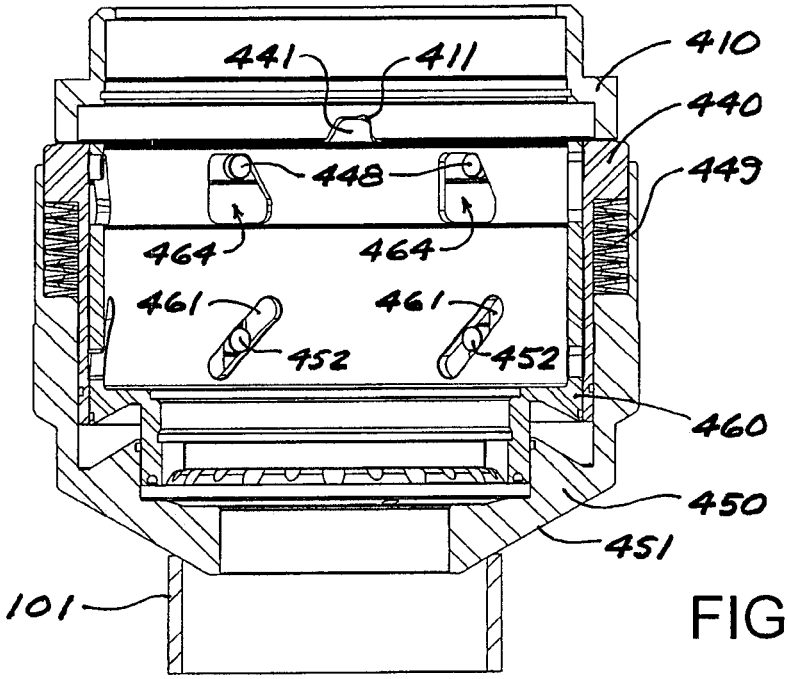
FIG. 9B is a cross-section through the latch release mechanism in FIG. 8B, shown after the application of axial load so as to stroke the latch release mechanism to cause rotary movement sufficient to release the latch.

Referring now to FIG. 9B, when sufficient force is applied by tubular workpiece 101 to overcome the force of trigger bias spring 449, movable bumper 450 moves upward, causing bumper cam follower 452 to move axially upward within cage cam slot 461. This axially-upward axial movement tends to rotate cage extension 460, but such rotation is resisted by the latch actuation torque acting between upper latch assembly 133 and lower latch assembly 134, which torque is transmitted through movable bumper 450 to trigger element 440 via bumper cam follower 452 and trigger cam slot 445, and through trigger dog tooth load flank 442 to reaction pocket load flank 412 and to upper latch assembly 133. This causes the latch actuation torque to be internally reacted, and causes trigger cam follower 448 to move along advance cam surface 466 to the advanced position within cage cam pocket 464, thereby disengaging drive cam latch hooks 401 from latch cam latch hooks 491 and changing the state of tri-cam latching linkage 132 from the latched position as in FIG. 8A to the unlatched position as in FIG. 9A, through right-hand rotation of upper latch assembly 133 relative to lower latch assembly 134. Once drive cam latch hooks 401 and latch cam latch hooks 491 have disengaged, the gas spring urges separation of upper latch assembly 133 from lower latch assembly 134. It is at this point in the operational sequence of casing running that a combination of axial tension and rotation will be applied during the course of connection make-up to induce right-hand rotation of upper latch assembly 133 relative to lower latch assembly 134. During this stage of operation, latch release mechanism 131 will not interfere with the regular function of the casing running tool.

Further upward movement of movable bumper 450 continues to urge rotation of cage extension 460 and, therefore, movement of trigger cam follower 448 to the withdrawn position within cage cam pocket 464, thereby moving trigger element 440 down and correspondingly withdrawing trigger dog teeth 441 from engagement with trigger reaction dog pockets 411 as shown in FIG. 10B. The angle of withdraw cam surface 467 relative to sloped cage cam slot 461 may be selected so as to promote the withdrawal of trigger dog teeth 441 from engagement with trigger reaction dog pockets 411 without jamming or otherwise inducing force in excess of the operative trigger bias force and frictional forces otherwise tending to affect the withdrawal movement.

With trigger element 440 withdrawn from trigger reaction ring 410 as shown in FIG. 10B, trigger dog tooth lock flank 444 is no longer opposite reaction pocket load flank 412, so upper latch assembly 133 can be rotated relative to lower latch assembly 134 in order to re-latch tri-cam latching linkage 132. As may be seen in FIG. 11A, this rotation of upper latch assembly 133 relative to lower latch assembly 134 causes latch cam latch hooks 491 to move into engagement with drive cam latch hooks 401 (i.e., the latched position), with the corresponding actuation torque induced by this rotation being resisted by tractional engagement of movable land surface 451 with tubular workpiece 101.

Figure 11A:
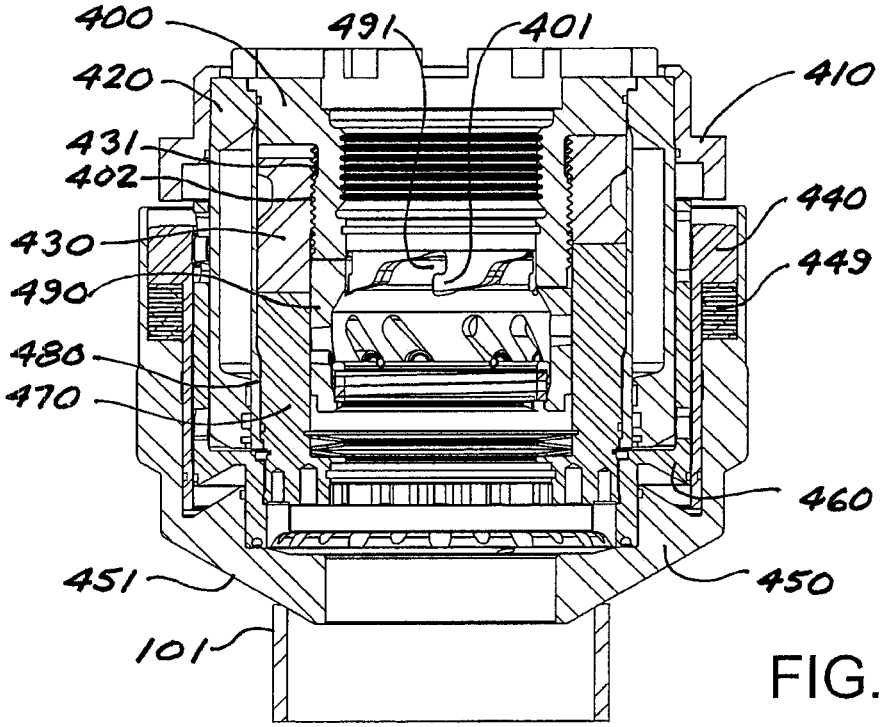
FIG. 11A is a cross-section through the tri-cam latching linkage and latch release mechanism in FIG. 8A, shown after rotation to re-latch the latch release mechanism.
Figure 11B:
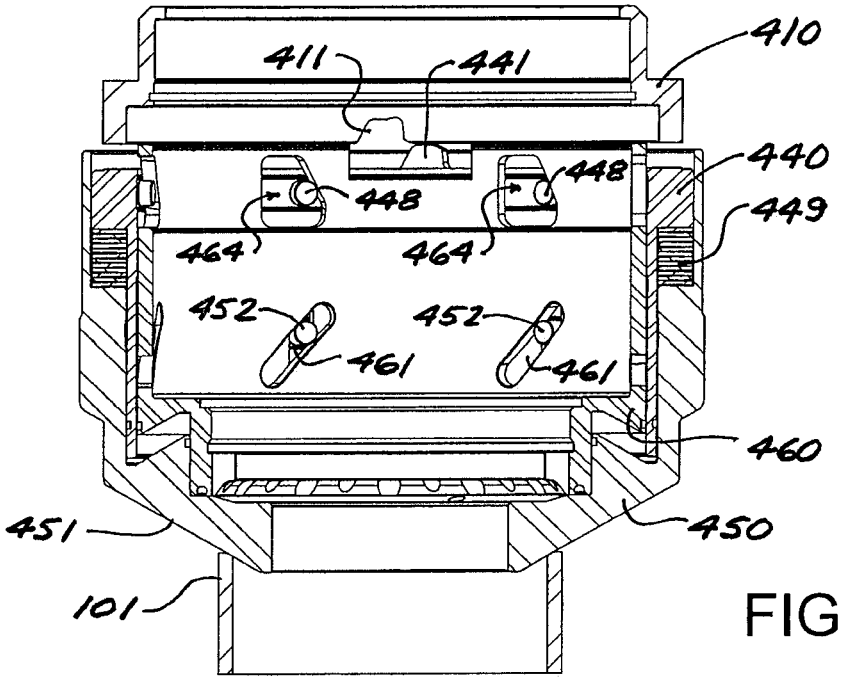
FIG. 11B is a cross-section through the latch release mechanism in FIG. 8A, shown after rotation to re-latch the latch release mechanism.

Referring now to FIG. 11B, with CRTi 130 thus in the re-latched position, as the operational step of removing CRTi 130 from tubular workpiece 101 reduces the axial force acting on movable land surface 451, trigger bias spring 449 urges movable bumper 450 downward and correspondingly causes movable bumper 450 to rotate relative to cage extension 460, with possible attendant sliding between movable land surface 451 and tubular workpiece 101. Tractional frictional force from trigger bias spring 449 thus tends to urge trigger element 440 to reverse the withdrawal movement described above, moving trigger dog teeth 441 upward. However, this upward movement of trigger dog teeth 441 is prevented by sliding engagement of trigger dog tooth crests 443 with reaction pocket crest 413, forcing trigger cam follower 448 to move from the withdrawn position to the reset position within cage cam pocket 464. As movable bumper 450 continues to move downward, following the movement of tubular workpiece 101, a point is reached where trigger dog tooth crests 443 no longer engage (i.e., they slide off) reaction pocket crest 413, thereby allowing trigger cam follower 448 to move from the reset position to the start position within cage cam pocket 464, thus returning latch release mechanism 131 to the position shown in FIG. 8A, from which position the operational sequence shown in FIGS. 8A to 11B can be repeated.

It will be readily appreciated by those skilled in the art that various alternative embodiments may be devised without departing from the scope of the present teachings, including modifications that may use equivalent structures or materials subsequently conceived or developed. It is to be especially understood that it is not intended for apparatus in accordance with the present disclosure to be limited to any described or illustrated embodiment, and that the substitution of a variant of a claimed element or feature, without any substantial resultant change in the working of the apparatus and methods, will not constitute a departure from the scope of the disclosure.

In this patent document, any form of the word "comprise" is to be understood in its non-limiting sense to mean that any item following such word is included, but items not specifically mentioned are not excluded. A reference to an element by the indefinite article "a" does not exclude the possibility that more than one of the element is present, unless the context clearly requires that there be one and only one such element. Any use of any form of the terms "connect", "engage", "couple", "latch", "attach", or any other term describing an interaction between elements is not meant to limit the interaction to direct interaction between the subject elements, and may also include indirect interaction between the elements such as through secondary or intermediary structure.

Relational and conformational terms such as (but not limited to) "vertical", "horizontal", "coaxial", "cylindrical", "trapezoidal", "upward-facing", and "downward-facing" are not intended to denote or require absolute mathematical or geometrical precision. Accordingly, such terms are to be understood as denoting or requiring substantial precision only (e.g., "substantially "vertical" or "generally trapezoidal") unless the context clearly requires otherwise.

Wherever used in this document, the terms "typical" and "typically" are to be understood and interpreted in the sense of being representative of common usage or practice, and are not to be understood or interpreted as implying essentiality or invariability.

Embodiments in which an exclusive property or privilege is claimed are defined as follows:

1. A mechanism comprising:

(a) an upper latch assembly and a lower latch assembly, said upper and lower latch assemblies being in axial alignment;

(b) an upper rotary latch component carried on and rotationally coupled to the upper latch assembly, and a lower rotary latch component carried on and rotationally coupled to the lower latch assembly;

(c) a bumper element defining a downward-facing land surface, said bumper element being coupled to the lower latch assembly so as to be both axially movable and rotationally movable relative to the lower latch assembly; and (d) a trigger element coupled to the bumper element and the lower latch assembly so as to be movable at least axially relative to the bumper element and so as to be axially and rotationally movable relative to the lower latch assembly;

wherein:

(e) the upper and lower rotary latch components are adapted to move from an axially-latched position to an axially-unlatched position in response to relative rotation between the upper and lower rotary latch components in a first rotational direction;

(f) the upper latch assembly defines one or more downward-facing trigger reaction dog pockets; and (g) the trigger element defines one or more upward-facing trigger dog teeth configured for engagement with the one or more trigger reaction dog pockets of the upper latch assembly;

such that when the one or more trigger dog teeth are disposed within the one or more trigger reaction dog pockets, an upward force applied to the land surface of the bumper element will tend to cause relative axially-upward displacement of the bumper urging rotation of the lower latch assembly, with the trigger acting between the bumper element and through engagement with the trigger dogs with the upper latch assembly to force relative rotation between upper and lower latch components to induce axial disengagement of the upper and lower rotary latch components, such that continued application of the upward force and resultant axial and rotary displacement of the bumper element relative to the lower latch assembly will cause withdrawal of the one or more trigger dog teeth from the one or more trigger dog reaction pockets.

2. A mechanism as in claim 1, wherein the bumper element is axially-movable relative to the trigger element by means of a first follower element rigidly coupled to the bumper element and movably disposed within an axially-oriented slot in the trigger element.

3. A mechanism as in claim 2, further comprising a second follower element rigidly coupled to the lower latch assembly and movably disposed within a pocket formed in the trigger element, such that the range of axial and rotational movement of the trigger element relative to the lower latch assembly is defined by the configuration of said pocket formed in the trigger element.

4. A mechanism as in claim 3, wherein the pocket formed in the trigger element is of trapezoidal configuration.

5. A mechanism as in claim 1, further comprising a third follower element rigidly coupled to the lower latch assembly and movably disposed within a bumper-trigger cam slot formed in the bumper element, such that the range of axially and rotational movability of the bumper element relative to the lower latch assembly is defined by the configuration of the bumper-trigger cam slot.

6. A mechanism as in claim 5, wherein the bumper-trigger cam slot is configured as elongate slot having a slope relative to vertical.

7. A mechanism as in claim 6, wherein the bumper-trigger cam slot is sloped at an angle of 45 degrees relative to vertical.

8. A mechanism as in claim 1, further comprising:

(a) a first axially-oriented biasing means, acting between the upper and lower latch assemblies so as to bias the latch release mechanism toward the latched position; and (b) a second axially-oriented biasing means, acting between the movable bumper element and the trigger element so as to bias the bumper element axially downward relative to the trigger element.

9. A mechanism as in claim 1, wherein the upper latch assembly comprises the main body assembly of a casing running tool (CRT) and the lower latch assembly comprises the grip assembly of the CRT.

10. A mechanism as in claim 9, wherein the lower latch assembly includes a cage extension rigidly coupled to the cage of the grip assembly of the CRT, and wherein the second and third follower elements are fixed to the cage extension.

11. A mechanism as in claim 10, wherein the cage extension, the trigger element, and the movable bumper are configured as a coaxially-nested group of closely-fitting cylindrical components, where relative rotary and translational movements between these components are constrained to keep them coaxially aligned.

12. A mechanism as in claim 1, wherein:

(a) the upper latch assembly defines a downward-facing upper ramp surface; and (b) the lower latch assembly defines an upward-facing lower ramp surface slidingly engageable with the upper ramp surface.

13. A mechanism as in claim 12, configured such that the application of an upward force to the land surface of the bumper element will bring the upper and lower ramp surfaces into sliding engagement so as to constrain the relative axial approach of the upper and lower latch assemblies while allowing relative rotation between the upper and lower latch assemblies.

* * * * *